US006386674B1

(12) United States Patent
Corrigan, III et al.

(10) Patent No.: US 6,386,674 B1
(45) Date of Patent: May 14, 2002

(54) INDEPENDENT POWER SUPPLIES FOR COLOR INKJET PRINTERS

(75) Inventors: George H Corrigan, III, Corvallis, OR (US); John M Wade, Poway, CA (US); Pere Esterri, Barcelona (ES); Clayton L Holstun, San Marcos; Glenn T Haddick, San Diego, both of CA (US); Jeffery S Beck; Dennis J. Schloeman, both of Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/429,942

(22) Filed: Oct. 29, 1999

Related U.S. Application Data

(63) Continuation-in-part of application No. 08/958,951, filed on Oct. 28, 1997, and a continuation-in-part of application No. 09/183,949, filed on Oct. 31, 1998.

(51) Int. Cl.[7] ..... B41J 29/393; B41J 29/38; B41J 2/21

(52) U.S. Cl. ..... 347/19; 347/12; 347/43

(58) Field of Search ..... 347/19, 12, 14, 347/23, 9, 13, 11, 10, 43

(56) References Cited

U.S. PATENT DOCUMENTS

| | | | | |
|---|---|---|---|---|
| 4,490,728 A | | 12/1984 | Vaught et al. | |
| 4,791,435 A | | 12/1988 | Smith et al. | |
| 5,068,674 A | | 11/1991 | Sato et al. | |
| 5,109,234 A | | 4/1992 | Otis, Jr. et al. | |
| 5,357,081 A | | 10/1994 | Bohorquez | |
| 5,418,558 A | | 5/1995 | Hock et al. | |
| 5,428,376 A | | 6/1995 | Wade et al. | |
| 5,448,269 A | * | 9/1995 | Beauchamp et al. | 347/19 |
| 5,471,163 A | | 11/1995 | Childers | |
| 5,473,351 A | | 12/1995 | Helterline et al. | |
| 5,475,405 A | | 12/1995 | Widder et al. | |
| 5,497,174 A | | 3/1996 | Stephany et al. | |
| 5,521,620 A | | 5/1996 | Becerra et al. | |
| 5,526,027 A | | 6/1996 | Wade et al. | |
| 5,541,629 A | | 7/1996 | Saunders et al. | |
| 5,677,577 A | | 10/1997 | Barbehenn et al. | |
| 5,682,185 A | | 10/1997 | Wade et al. | |
| 5,751,302 A | | 5/1998 | Rezanka | |
| 5,754,193 A | | 5/1998 | Elhatem | |
| RE36,279 E | | 8/1999 | Ujita | |

FOREIGN PATENT DOCUMENTS

| | | |
|---|---|---|
| JP | 60-206664 | 10/1985 |
| JP | 61-197247 | 9/1986 |

* cited by examiner

*Primary Examiner*—John Barlow
*Assistant Examiner*—Charles W. Stewart, Jr.
(74) *Attorney, Agent, or Firm*—Robert C. Sismilich

(57) ABSTRACT

An inkjet printing system having multiple independent power supplies for providing firing energy to the ink ejection elements of one or more printheads. Different ones of the power supplies can be connected to different print cartridges each of which prints a different color ink; to different arrays of ink ejection elements within a single print cartridge, where each array prints a different color ink; or to different sections of the ink ejection element array of a single printhead for a single color ink. The output of each power supply is independently set to an appropriate voltage level for each different print cartridge, ink ejection element array, or section of an array.

36 Claims, 15 Drawing Sheets

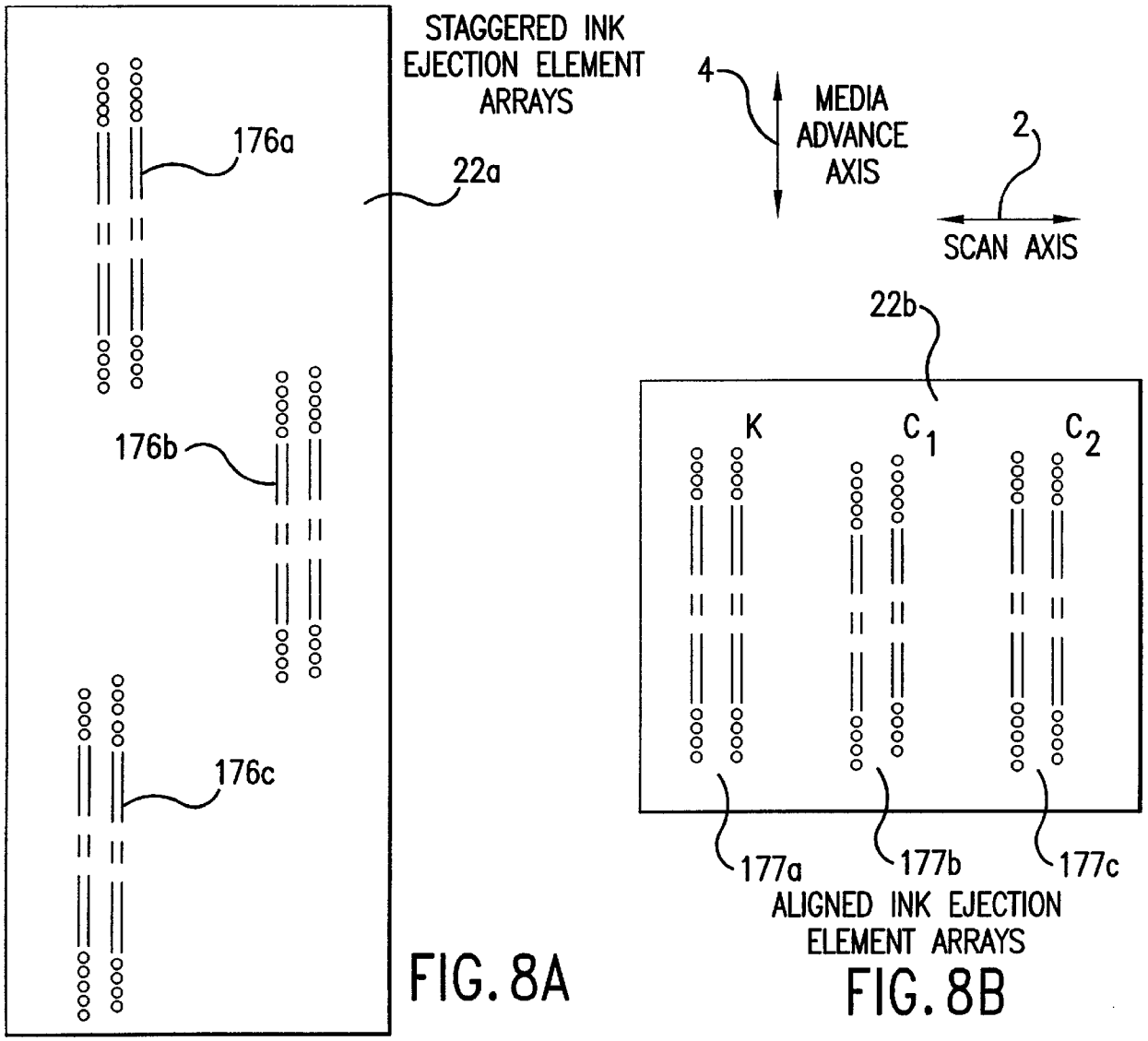
FIG. 8B
FIG. 8A
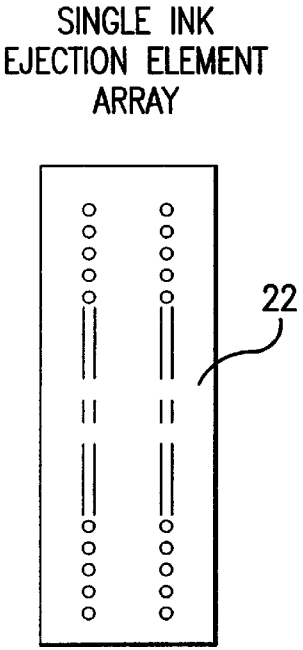
FIG. 6B

INDEPENDENT POWER SUPPLIES FOR COLOR INKJET PRINTERS

Cross-Reference to Related Applications

This application is a continuation-in-part of the co-pending U.S. application Ser. No. 08/958,951, by Corrigan et al., filed Oct. 28, 1997, titled "Thermal Ink Jet Print Head and Printer Energy Control Apparatus and Method". This application is also a continuation-in-part of the co-pending U.S. application Ser. No. 09/183,949, by Holstun et al., filed Oct. 31, 1998, titled "Varying the Operating Energy Applied to an Inkjet Print Cartridge Based Upon the Operating Conditions", which is assigned to the assignee of the present invention and hereby incorporated by reference in its entirety.

This application also relates to the subject matter disclosed in the co-pending U.S. application Ser. No. 09/016,478, by Askeland et al., filed Jan. 30, 1998, entitled "Hybrid Multi-Drop/Multi-Pass Printing System"; the co-pending U.S. application Ser. No. 08/962,031, by Courian et al., filed Oct. 31, 1997, entitled "Ink Delivery System for High Speed Printing"; the co-pending U.S. application Ser. No. 09/071,138, by Wade et al., filed Apr., 30, 1998, titled "Energy Control Method for an Inkjet Print Cartridge"; the co-pending U.S. application Ser. No. 09/253,441, by Barbour et al, filed Feb. 19, 1999, titled "A High Performance Printing System and Protocol"; the co-pending U.S. application Ser. No. 09/496,136 by Haddick, filed concurrently herewith, titled "Reliable Space-Efficient Printer Pen Flex Circuit"; and the co-pending U.S. application Ser. No. 09/429,941, by Wade et al., filed concurrently herewith, titled "Multiple Power Interconnect Arrangement for Inkjet Printhead"; all of which are assigned to the assignee of the present invention and hereby incorporated by reference in their entirety.

FIELD OF THE INVENTION

The present invention relates generally to thermal ink jet printers, and more particularly to the supplying of power signals to the ink ejection elements of thermal ink jet printers.

BACKGROUND OF THE INVENTION

Inkjet hardcopy devices, and thermal inkjet hardcopy devices such as printers, plotters, facsimile machines, copiers, and all-in-one devices which incorporate one or more of these functions in particular, have come into widespread use in businesses and homes because of their low cost, high print quality, and color printing capability. These hardcopy devices are described by W. J. Lloyd and H. T. Taub in "Ink Jet Devices", Chapter 13 of *Output Hardcopy Devices* (Ed. R. C. Durbeck and S. Sherr, San Diego: Academic Press, 1988). The basics of this technology are further disclosed in various articles in several editions of the *Hewlett-Packard Journal*[Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994)], incorporated herein by reference.

The operation of such printers is relatively straightforward. In this regard, drops of a colored ink are emitted from a printhead onto the print media such as paper or transparency film during a printing operation, in response to commands electronically transmitted to the printhead. These drops of ink combine on the print media to form the text and images perceived by the human eye. Color inkjet printers use a number of different ink colors in order to form a wide range of colors and intensities. The colors can be produced through the use of dye or pigments in the ink. Printheads for one or more color inks may be contained in a print cartridge. The ink supply for the printheads may be contained in the print cartridge housing the printhead, or ink may be continuously or intermittently supplied to the printhead from an ink supply located elsewhere. An inkjet printer frequently can accommodate two to four print cartridges, or more. The cartridges typically are mounted side-by-side in a carriage which scans the cartridges back and forth within the printer in a forward and a rearward direction above the media during printing such that the cartridges move sequentially over given locations, called pixels, arranged in a row and column format on the media which is to be printed. Each print cartridge typically has an arrangement of individually controllable printhead ink ejection elements for controllably ejecting the ink onto the print media, and thus a certain width of the media corresponding to the layout of the ink ejection elements on the print cartridge, can be printed during each scan, forming a printed swath. The printer also has a print medium advance mechanism which moves the media relative to the printheads in a direction generally perpendicular to the movement of the carriage so that, by combining scans of the print cartridges back and forth across the media with the advance of the media relative to the printheads, ink can be deposited on the entire printable area of the media.

Each ink ejection element, or firing unit, includes an ink chamber connected to an ink source, and to an ink outlet nozzle. A transducer within the chamber provides the impetus for expelling ink droplets through the nozzles. In thermal ink jet printers, the transducers are thin film firing resistors that generate sufficient heat during application of a brief voltage pulse to vaporize a quantity of ink sufficient to expel a liquid droplet.

A power source in the printer connects to the print cartridge to supply electrical power (a certain amount of current at a certain voltage) to the firing resistors in the ink ejection elements for a certain amount of time in order to provide the electrical energy required to eject ink drops from the elements. The energy applied to a firing resistor affects its performance, durability, and efficiency. It is well known that the firing energy must be above a certain threshold, known as the turn-on energy, to cause a vapor bubble large enough to expel a drop to nucleate. Above this threshold is a transitional range, in which increasing the energy increases the drop volume expelled. Above a higher threshold at the upper limit of the transitional range, drop volumes do not increase with increasing energy. It is in this upper range in which drop volumes are stable even with moderate energy variations that printing optimally takes place, because the variations in drop volume that cause disuniformities in printed output can be avoided when operating in the upper range. If the applied energy levels increase above this optimal zone, however, drop volume uniformity is not compromised, but rather energy is wasted resulting in excessive temperature rise, and the printer components are prematurely aged due to excessive heating and ink residue build up.

For achieving high print quality, it is frequently desirable to print using different drop volumes for different color inks, or for different shades of the same color ink. Therefore, the design of the printheads may differ from ink to ink in order to produce different stable drop volumes. Different stable drop volumes require different amounts of firing energy; the amount of firing energy required to produce stable drop volumes is generally proportional to the stable drop volume. For example, an ink ejection element designed to produce 30 picoliter drops requires approximately 1.5 times the firing energy required to produce 20 picoliter drops from a differently-designed ink ejection element.

Producing different firing energies for different printheads with different stable drop volumes can be problematic if the printer uses a power supply having only a single output voltage. If a firing pulse of the same voltage is applied to the ink ejection elements of all printheads, then the firing time (the amount of time that the voltage is applied to the ink ejection elements) must be varied in order to provide the proper optimal energy. While this solution is adequate if the required .amount of variation in firing times is not too great between different printheads, there are limitations as to how much the firing time can be varied to compensate for different printheads which, if they are designed to deliver different drop volumes, require different firing voltages. If the voltage applied to a particular printhead is too low for that printhead, requiring that the pulse be lengthened in order to provide the proper firing energy, the pulse may become so long as to undesireably reduce the frequency at which the ink ejection elements can be fired, slowing down printing from the printer. Conversely, if the applied voltage is too high for the printhead, requiring the pulse be shortened in order to provide the proper firing energy, the voltage may be so high and the pulse so short as to cause premature aging and possible failure of the printhead. Thus the voltage appropriate to the design of each particular print cartridge must be supplied in order to avoid these problems, resulting in a need for multiple power sources in printing systems which use printheads having different drop volumes.

The need for supplying different power supply voltages to different print cartridges can also arise even in printheads having the same stable drop volume and firing energy. Parasitic electrical resistances within each print cartridge have the effect of reducing the firing voltage applied to the ink ejection elements below the voltage which is supplied to the electrical interconnection pads of the print cartridge by the power supply in the printer. Manufacturing tolerances can result in the parasitic resistances varying from print cartridge to print cartridge. Since the power supply voltage can only be set to match the parasitic resistances of one of the print cartridges, other print cartridges having different parasitic resistances must operate with non-optimal voltages and thus can suffer from the slower printing or premature aging problems discussed above. To provide the highest print quality would require either that print cartridges be "matched" to each other, which is impractical in a printing system with individually replaceable print cartridges, or that manufacturing tolerances be set more tightly, which would likely result in increased print cartridge cost.

Even within an individual printhead, a similar need for supplying differing input voltages can arise. In highly multiplexed printheads having a large number of ink ejection elements, different sets or groups of the elements may each be powered by a different common voltage line. If the parasitic resistances in the current path from the electrical interconnection pads to the firing resistors is different for different groups of the ink ejection elements in the printhead, different voltage levels will be required to be supplied to the interconnection pads in order to compensate for the voltage drop through the parasitic resistances and thus provide the required firing energy to each ink ejection element group. In addition to differing parasitic resistances in the current paths of different ink ejection element groups, the number of ink ejection elements that are simultaneously fired in a group can affect the firing energy. When a larger (or smaller) number of resistors is fired in one group compared to another, the increased (or decreased) current drawn from the power supply causes a larger (or smaller) voltage drop through the parasitic resistances, which in turn requires a higher (or lower) output voltage from the power supply applied to the interconnection pads in order to provide the required firing energy to the elements.

In the past, thermal inkjet printers have supplied only a single firing voltage to an individual print cartridge. In addition, past thermal inkjet printers have supplied the same firing voltage to the print cartridges and printheads for different colored (i.e. non-black) inks, with either the same or a different firing voltage supplied to the black ink print cartridge. Supplying inappropriate firing voltages to thermal inkjet printheads can result in less than optimal print quality or a reduction in printhead life. Accordingly, there is still a need for a multicolor thermal inkjet printer which provides appropriate firing voltages to different groups of ink ejection elements in order to provide printed output of high quality.

SUMMARY OF THE INVENTION

In a preferred embodiment, the present invention provides an inkjet printing system with a plurality of power sources, each of which can be connected to a group of ink ejection elements and can be independently set to a different voltage level, in order to provide the appropriate firing voltages to each of the different ink ejection element groups. The system has a carriage movably mounted in the frame with respect to the media. The carriage has at least one slot into which a print cartridge containing groups of ink ejection elements can be removably mounted. Each of the ink ejection elements is individually actuable by the application of a firing energy to emit ink drops of a given drop volume. In one preferred embodiment, each ink ejection element group emits drops of the same color ink, while in an alternate preferred embodiment certain different groups each emits drops of a different color ink. In some embodiments, at least two of the groups emit drops of different color inks, each of which have the same drop volume. The ink ejection element groups can be disposed in print cartridge in a number of alternative arrangements. One or more of the ink ejection element groups are disposed in each print cartridge. In some embodiments, all groups are disposed in a single print cartridge. In other embodiments, all groups for a single color ink are located in the same print cartridge. In yet other embodiments, print cartridges contains ink ejection element groups for only a single color ink, or for multiple different color inks. The plurality of power sources preferentially includes a plurality of power supplies, each of which has an independently settable output voltage. Typically, each of the power supplies has an input line connected to the AC power mains. In some embodiments, at least two of the plurality of power supplies have output ground lines which are commonly connected. In an alternate embodiment, the plurality of power sources includes at least one power supply having an output connected to a plurality of voltage regulators, each of which provides independently settable output voltages. Typically, at least two of the voltage regulators have output ground lines which are commonly connected.

In an alternate embodiment, the present invention provides a print cartridge for printing drops of different inks using an inkjet printer. The cartridge includes a printhead die having multiple groups of ink ejection elements. The printhead die also has multiple firing pulse inputs, certain of which are commonly connected to certain ink ejection element groups for controllably ejecting drops of ink. The cartridge also includes a conductive circuit connected to the printhead die, the circuit having multiple power interconnect pads, each of which receives a firing pulse, and electrically conductive traces for conducting the firing pulses from the interconnect pads to the firing pulse inputs of the printhead die. Different color inks may be emitted by different ink ejection element groups; the colors preferentially include black, magenta, cyan, yellow, light magenta, light cyan, dark magenta, and dark cyan color inks. The drop volume of each emitted ink drop may be different in some embodiments for different ink ejection element groups, or for ink ejection groups associated with different color inks. Alternatively, the drop volumes may be substantially the same for at least some of the ink ejection element groups for differently colored inks. Each of the firing pulses has a voltage provided by a power source electrically connected to the power interconnect pads. In some embodiments, the voltages are different for some of the firing pulses. These different voltages are preferably provided by multiple independent power supplies which are electrically connected to different power interconnect pads. In embodiments in which each ink ejection element group has a parasitic resistance, the different voltage values compensate for the different parasitic resistances so as to provide a predetermined firing energy to the corresponding ink ejection element group. In other embodiments in which each ink ejection element group has a predetermined drop volume, the different voltage values provide a corresponding predetermined firing energy to each of the groups.

The present invention may also be implemented as a method for printing with an inkjet printer. The method includes providing multiple ink ejection element groups which each selectively eject ink in response to one of the firing pulses, and providing independently settable firing voltage levels for each of the firing pulses. Power sources may be electrically connected to the groups to provide the firing pulses. The voltage levels are set to an appropriate voltage value for the group, and the firing pulses are selectively generated as governed by the data to be printed so as to emit ink drops. The ink ejection elements from which ink drops are to be printed are selected based on the print data. The voltage value for each group may be set so as to emit a desired ink drop volume from the ink ejection elements. In addition, parasitic resistances of the ink ejection elements in a group may be determined, and the voltage value for the group set so as to compensate for the effect of the parasitic resistances. The ink ejection elements may be housed in one or more print cartridges, with a supply of ink provided to each ink ejection element group in the cartridge. The supply of ink may alternatively be located in the print cartridge, in a reservoir detachably connected to the print cartridge, and in an off-carriage reservoir fluidly connected to the print cartridge.

Other aspects and advantages of the present invention will become apparent from the following detailed description, taken in conjunction with the accompanying drawings, illustrating by way of example the principles of the invention.

BRIEF DESCRIPTION OF THE DRAWINGS

FIG. 6B shows a single ink ejection element array for a single color ink usable in the print cartridge of FIG. 2A.

FIG. 8A shows an staggered arrangement of three ink ejection element arrays for printing non-overlapping swaths of three different color inks, the arrangement usable in the print cartridge of FIG. 2A.

FIG. 8B shows an aligned arrangement of three ink ejection element arrays for printing overlapping three different color inks, the arrangement usable in the print cartridge of FIG. 2A.

DESCRIPTION OF THE PREFERRED EMBODIMENT

Figure 1A:
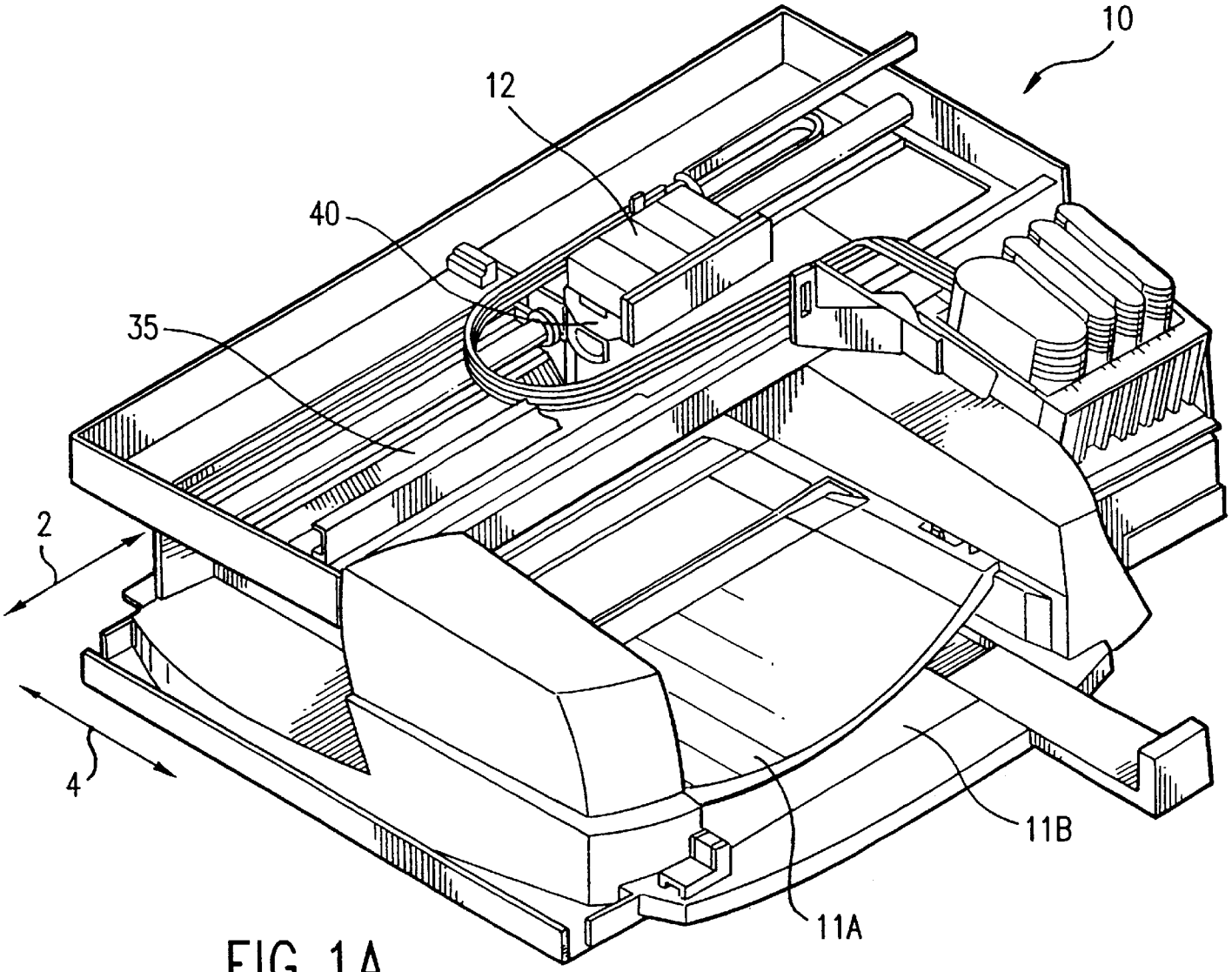
FIGS. 1A and 1B are perspective views of two different inkjet printers embodying the present invention.

FIG. 1A is a perspective view of one embodiment of an inkjet printer 10 suitable for utilizing the present invention, with its cover removed. Generally, printer 10 includes a tray 11A for holding virgin paper. When a printing operation is initiated, a sheet of paper from input tray 11A is fed into printer 10 using a sheet feeder, then brought around in a U direction to now travel in the opposite direction toward output tray 11B. The sheet is stopped in a print zone 35, and a scanning carriage 40, supporting one or more print cartridges 12, is then passed across a print zone on the sheet for printing a swath of ink thereon. The printing may occur while the carriage is passing in either directional. This is referred to as bi-directional printing. After a single pass or multiple passes, the sheet is then incrementally shifted an amount based on the printmode being used, using a conventional stepper motor and feed rollers to a next position within the print zone 35, and carriage 40 again passes across the sheet for printing a next swath of ink. When the printing on the sheet is complete, the sheet is forwarded to a position above tray 11, held in that position to ensure the ink is dry and then released. The carriage 40 scanning mechanism may be conventional and generally includes a slide rod, along which the carriage 40 slides, a flexible cable (not shown in FIG. 1A) for transmitting electrical signals from the printer's controller to the carriage 40 and then to electrodes on the carriage 40 which engage electrical contact pads 312 on print cartridges 12 when they are installed in the printer. A motor (not shown), connected to carriage 40 using a conventional drive belt and pulley arrangement, may be used for transporting carriage 40 across print zone 35.

Figure 1B:
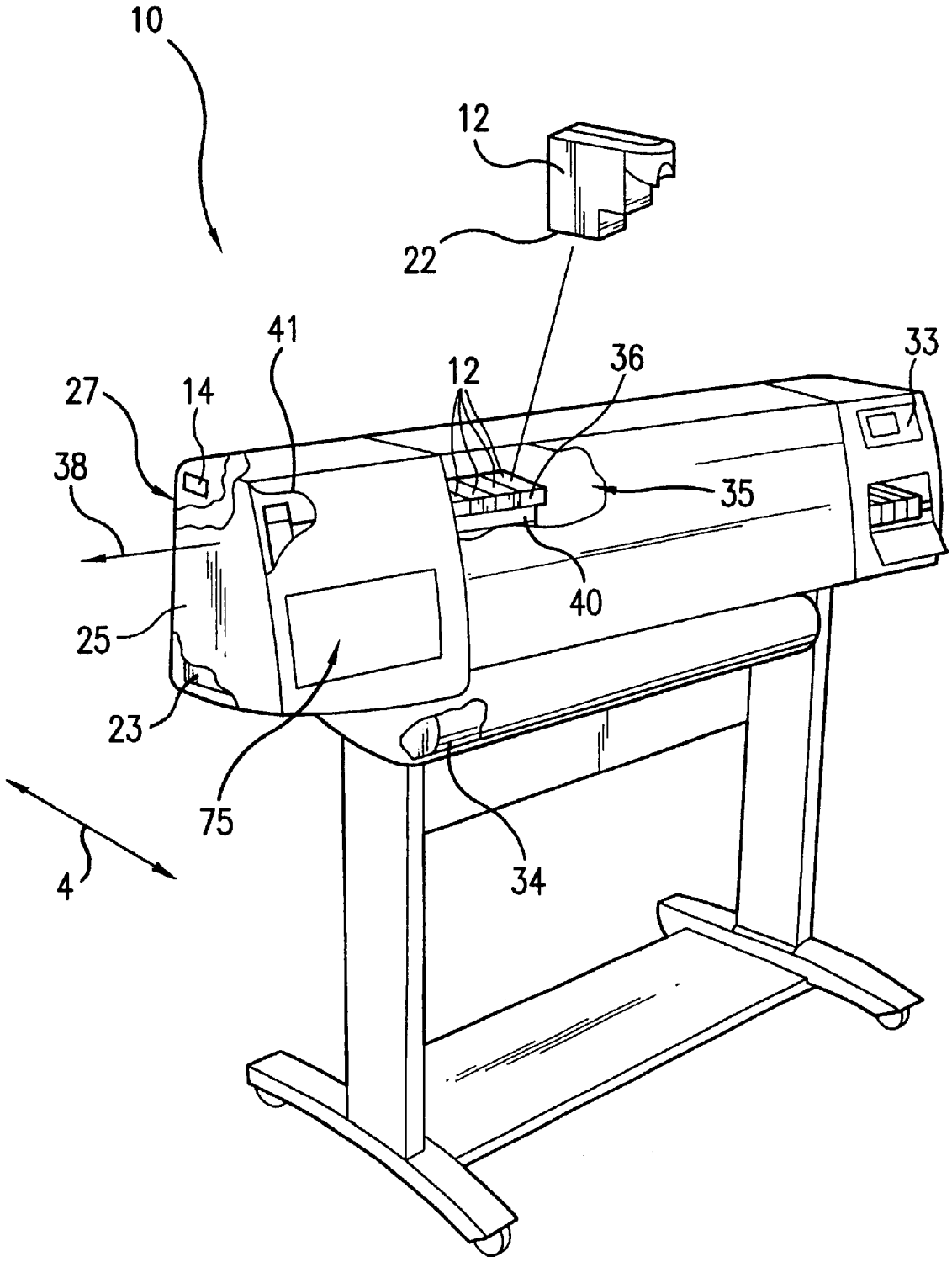

Referring now to another embodiment of an inkjet printing system 10 suitable for utilizing the present invention, and as illustrated in the perspective view of in FIG. 1B, the inkjet printing system 10 includes a chassis 23 surrounded by a housing 25 forming a print assembly portion 27 of the printer 10. While it is apparent to those skilled in the art that exact printer components may vary of model to model, the printer 10 has a print controller 14 that receives instructions from a host device (not shown), typically a computer. The print controller 14 may also operate in response to user inputs provided through a keypad and status display portion 33 located on the exterior of the housing 24. A monitor (not shown) coupled to the computer may also be used to display visual information to an operator, such as the printer status or the user interface of an applications program being run on the computer. Computers and input devices, such as keyboards and pointing devices, are all well known in the art.

A carriage guide rod 36 is mounted to the chassis 22 to define a scanning axis 2, with the guide rod 36 slideably supporting a carriage 40 for relative motion with the media. A conventional carriage drive motor 41 may be used to propel the carriage 40 in response to a control signal from the controller 14, and a conventional positional feedback mechanism (not shown) communicates the present carriage position to the controller 30. A conventional print media handling system (not shown) may be used to advance a continuous sheet of print media 34, such as paper or transparencies, from a roll through a printzone 35 and along a media advance axis 4 substantially orthogonal to the scanning axis 2. Alternatively, a sheet feed mechanism (not shown) may perform the same function for flat sheet media.

In the printzone 35, the media receives drops of ink from a print cartridge 12. One or more print cartridges 12 can be removably mounted in the carriage 40. Each print cartridge 12 contains at least one supply of pigment-based or dye-based ink. Each supply of ink may be of a different color; typically, black, cyan, magenta, and yellow inks are utilized. It is apparent that other colors or types of inks, such as paraffin-based inks or hybrid inks having both dye and pigment characteristics, may be used in the print cartridge 12 without departing from the scope of the present invention. Each print cartridge 12 contains one or more printhead die 22 having ink ejection elements. The ink ejection elements on each die 22 may be further divided into groups, with each group preferably for ejecting only a single color ink. A single die 22 may have multiple ink ejection element groups for printing corresponding multiple ink colors, or multiple die 22 each for printing a single ink color may be included in the cartridge 12. Configurations of print cartridges 12, and the printhead dies 22 contained therein, usable with the current invention will be discussed hereinafter in greater detail. The ink ejection elements are designed for printing ink drops of a certain drop volume. Typically, the colored (non-black) ink ejection elements are designed to print one optimal drop volume, and the black ink ejection elements are designed to print a different optimal drop volume. The exemplary printing system 10 uses an off-carriage ink delivery system to supply the ink to the printhead die 22, having main stationary ink reservoirs (not shown) for each color ink located in an ink supply region 75. In this off-carriage system, the supply of ink in the print cartridges 12 are replenished by ink conveyed through a conventional flexible tubing system (not shown) connecting the stationary reservoirs to the cartridges. Consequently, only a small amount of ink is included in the cartridges propelled by the carriage 40 across the printzone 35. Alternative ink delivery systems usable with the present invention will be discussed subsequently.

Figure 2A:
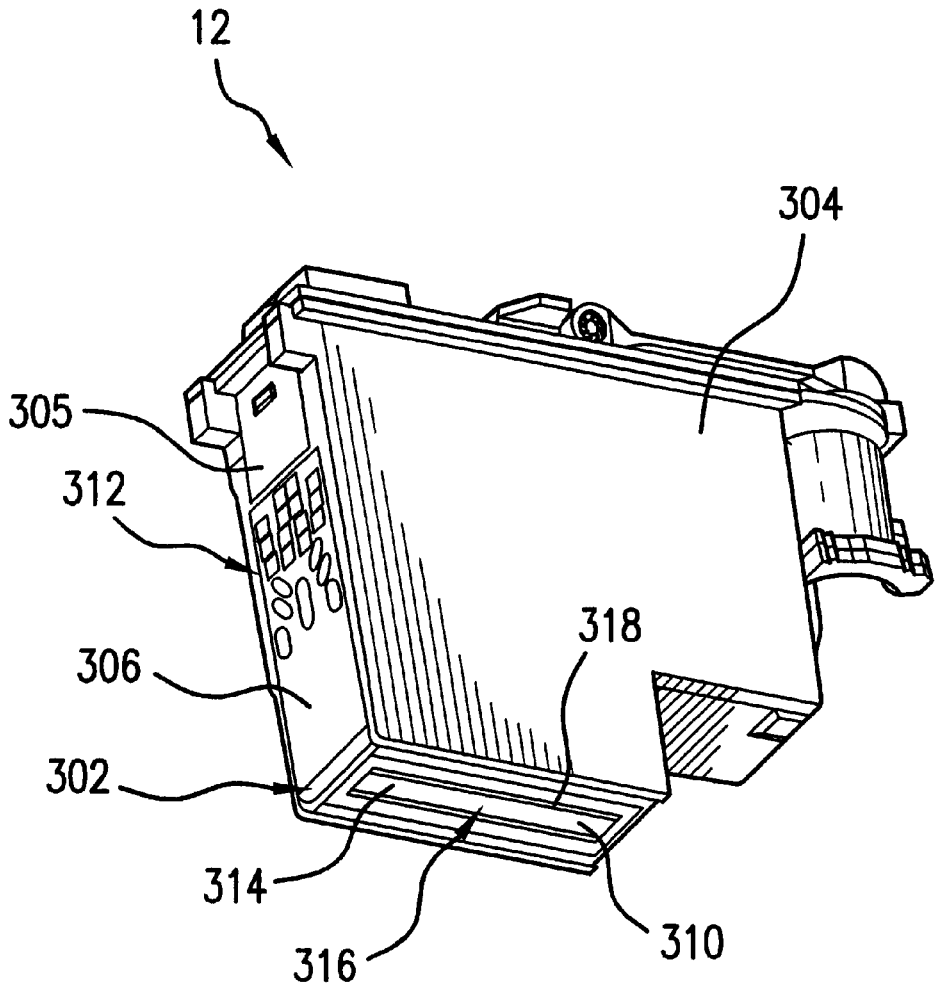
FIG. 2A is a perspective view of a print cartridge usable with the inkjet printers of FIGS. 1A and 1B.

FIG. 2A illustrates a print cartridge 12 having a printhead assembly (also known as a "tab head assembly" or "THA") 302 attached which includes a flexible tape 306 having a printhead portion indicated generally at 316. In the printhead portion 316, the THA 302 has a plurality of nozzles 314 through which ink drops from at least one ink ejection element array are ejected. Electrical contact pads 312 included on the front surface of the flex circuit 306 align with and electrically contact electrodes (not shown) on carriage 40. The print cartridge 12 also includes a memory device 306 for storing calibration information determined on the manufacturing line or subsequently. Values typically include operating voltage, operating energy, turn-on energy, print cartridge resistances including common parasitic resistances and drop volumes. This information can the be read and stored by the printer 10 when the print cartridge 12 is installed in the printer 10.

Figure 2B:
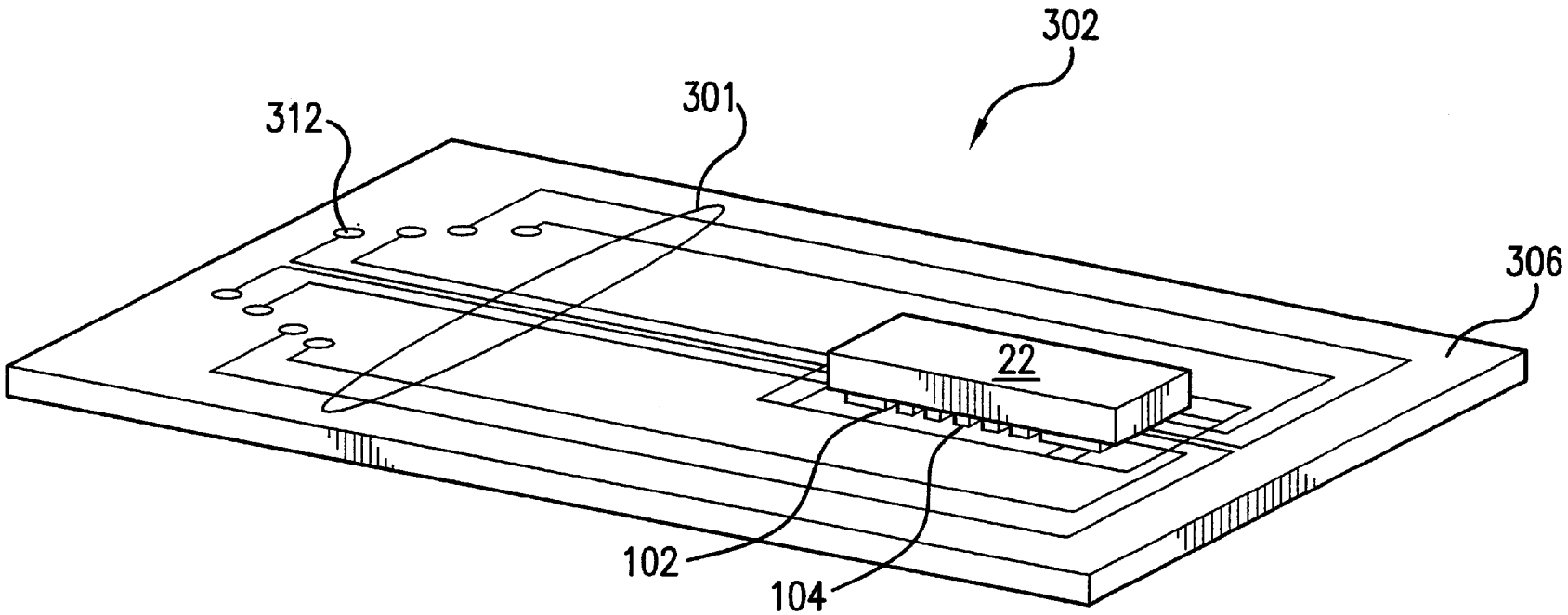
FIG. 2B is a schematic view of a tab head assembly incorporated in the print cartridge of FIG. 2A.
Figure 4A:
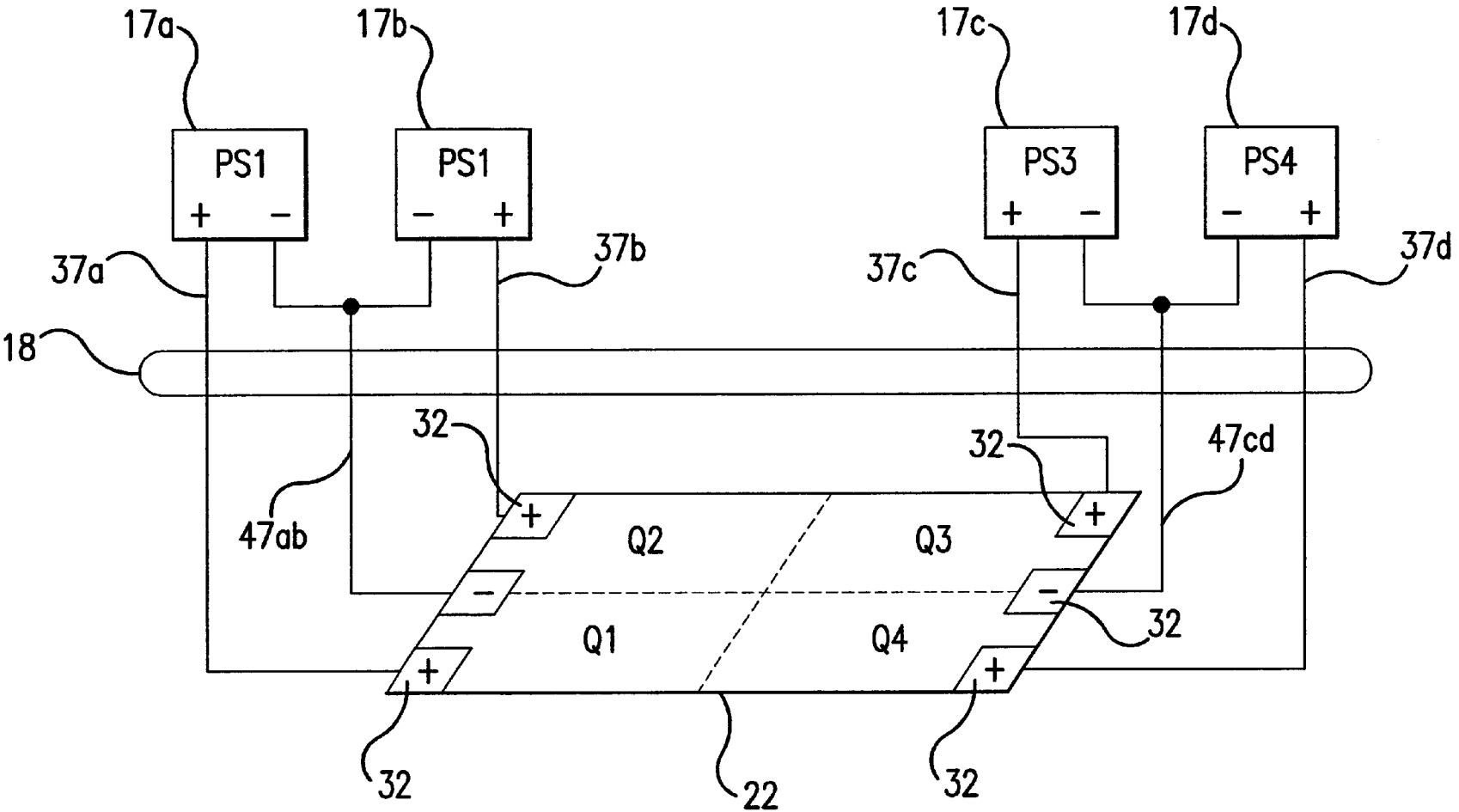
FIG. 4A is a schematic representation of a first embodiment showing independent power supplies connected to different sections of the printhead die of FIG. 3.
Figure 4B:
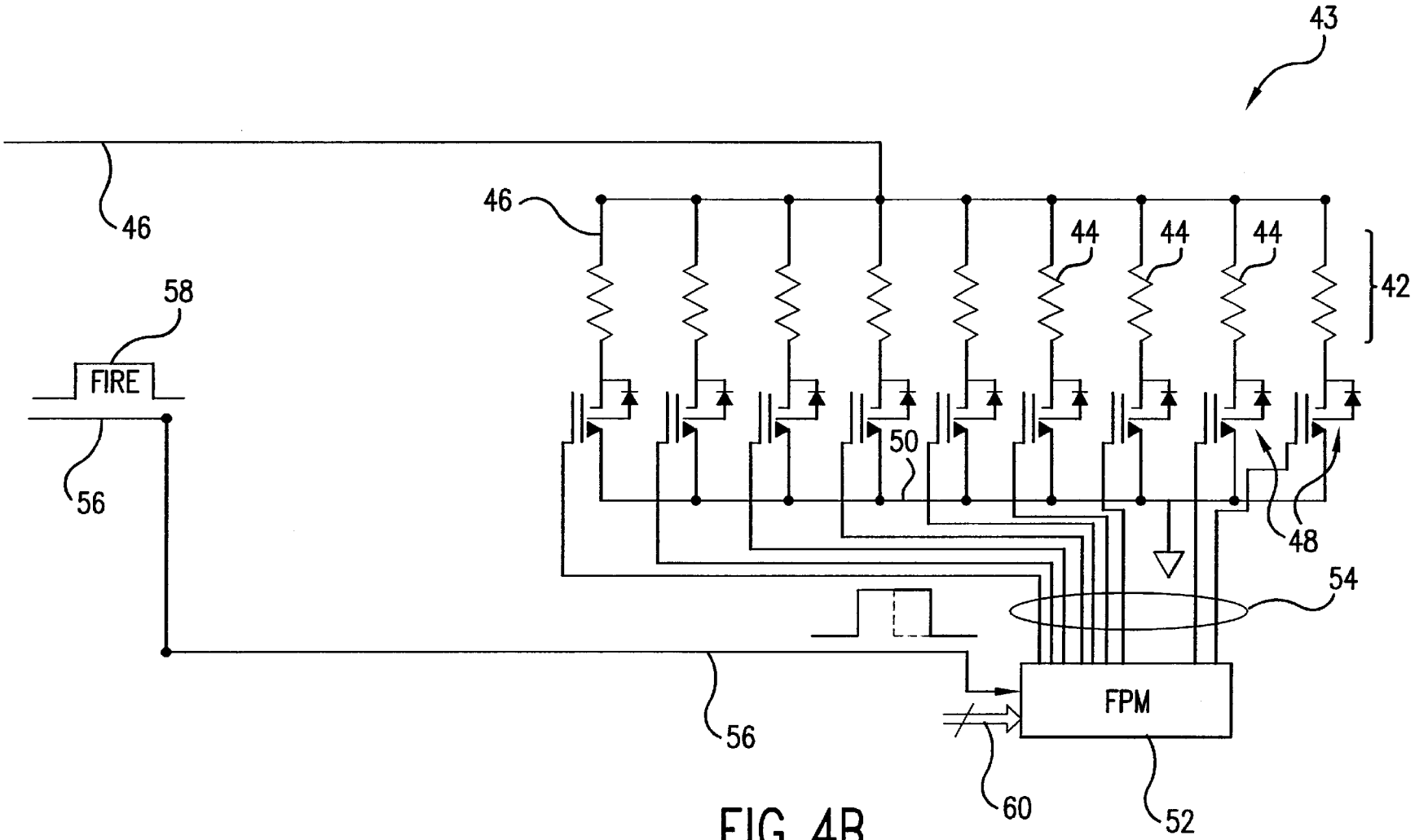
FIG. 4B is a schematic circuit diagram of a portion of the printhead die of FIG. 3.

Referring to FIGS. 2B and 4B, printhead assembly 302 is preferably a flexible polymer tape 306, containing nozzles 314 formed therein by laser ablation, attached to a substrate, or die, 22 having ink ejection elements, which are typically resistors 44, formed thereon. Conductive traces 301 are formed on the back of tape 306 and terminate in contact pads 312 on the front of flex circuit tape 306 for contacting electrical contacts on carriage 40. The other ends of conductors 301 are bonded to electrodes 406 of substrate 22. At least one array of ink ejection chambers 102 are formed in a barrier layer 104 between the substrate 22 and the tape 306, each of the chambers 102 associated with one of the resistors 44. The flex circuit tape 306 is suitably secured to the print cartridge 12 by, for example, an adhesive material.

The physical configuration of the print cartridge 12 and printhead assembly 302 is described in further detail in the co-pending and commonly-assigned U.S. applications "Reliable Space-Efficient Printer Pen Flex Circuit", by Haddick, and "Multiple Power Interconnect Arrangement for Inkjet Printhead", by Wade et al., both of which have been heretofore incorporated by reference in their entireties.

Figure 3:
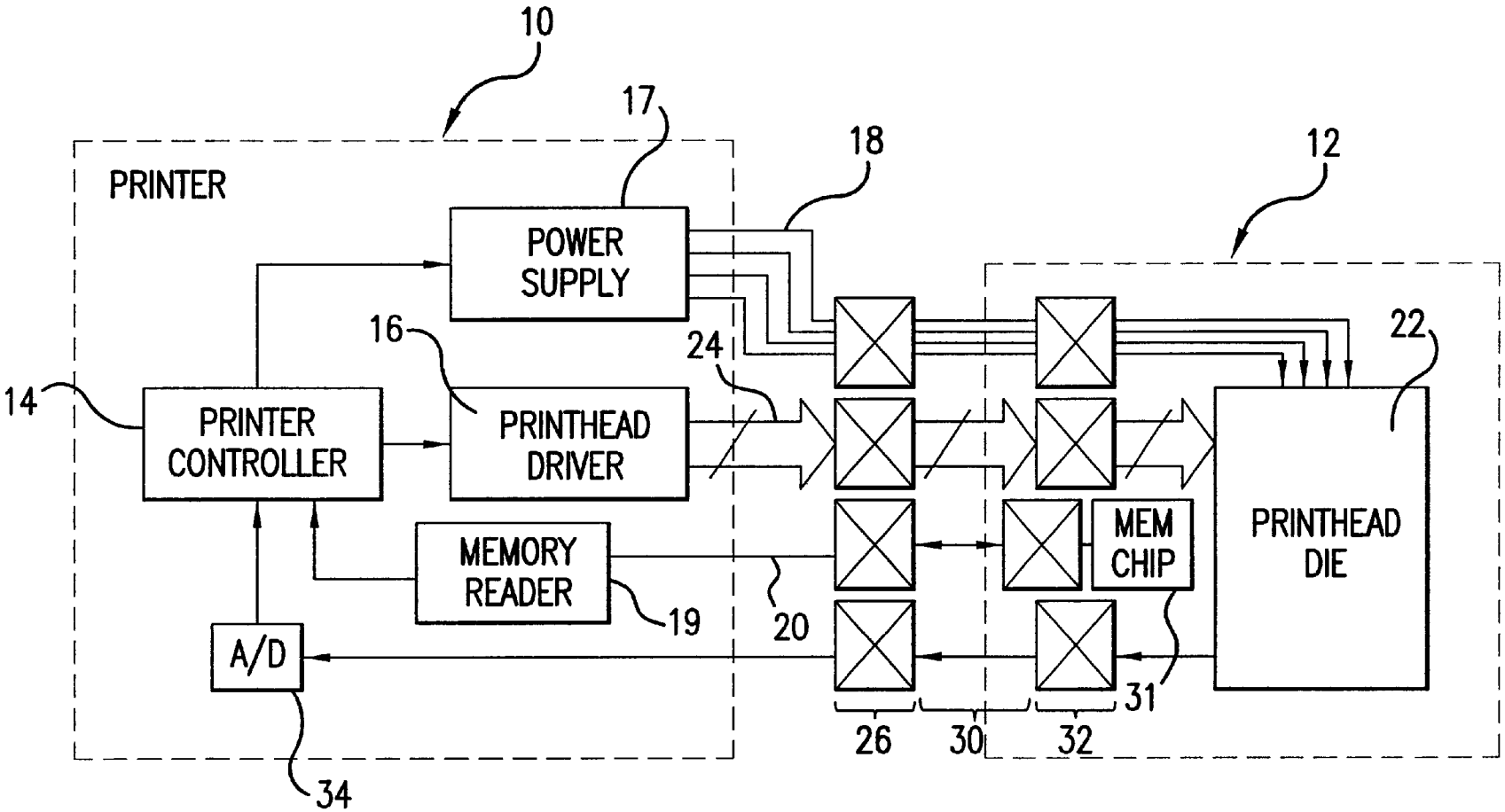
FIG. 3 is a schematic block diagram of a printing system embodying the present invention.

FIG. 3. shows a schematic block diagram of an ink jet printer 10 with a connected print cartridge 12. A controller 14 in the printer receives print data from a computer or microprocessor (not shown) and processes the data to provide printer control information or image data to a print head driver circuit 16. A controlled voltage power supply 17 provides to a four line power bus 18 a controlled supply voltage. A memory reader circuit 19 in the printer is connected to the controller for transmitting information received from the print cartridge 12 via a memory line 20. The print head driver circuit is controlled by the controller to send the image data to a print head die 22 on the print cartridge 12, via a control bus 24 that has about twenty lines.

The cartridge is removably replaceable, and is electrically connected to the printer by the control bus 24, power bus 18, memory line 20 and thermal data line to be discussed below. A connector interface 26 has a conductive pin for each line on the printer side contacting a corresponding pad on a flexible circuit 30 on the cartridge 12. A memory chip 31 on the cartridge stores printer control information programmed at production of the cartridge, or by the printer during use. The flex circuit 30 is connected to the print head die 22 via tab bonds 32. An analog-to-digital converter 34 in the printer is connected to the print head to receive data from the print head that indicates the print head's temperature.

Referring now to the schematic block diagram of FIG. 4A, in a preferred first embodiment of the present invention, the print head has 524 nozzles, each with an associated firing resistor. The print head is arranged into four similar quadrants, Q1 through Q4, each having eight "primitives" of 16 nozzles each, plus four primitives (one per quadrant) of three nozzles each. To provide a multiplexed function requiring only a limited number of lines between the printer and print head, resistor current flows through a voltage line (such as a line 37*a*) and a ground line (such as a line 47*ab*) shared by other resistors in its quadrant. The resistors are individually addressable to provide unlimited pattern permutations, by a serial data stream fed from the print head.

FIG. 4B shows a representative quadrant of the die 22, including a firing control circuit 43 and an exemplary fraction of the many resistors 44 on the printhead. Printhead includes substrate 22 having firing resistors 44 and nozzles 314 in tape 306. The firing control circuit 43 resides on the printhead substrate 22 and has a single pad to pad voltage input ($V_{pp}$) 46 from the power bus 18 commonly connected to a set 42 of thin film firing resistors 44. Each firing resistor 44 is connected to a corresponding firing switch 48 connected to a ground line 50 and having a control input connected to the output 54 of a firing pulse modulator 52. The firing pulse modulator 52 receives print data on a bus 60 and outputs a firing signal on output lines 54 to each selected firing switch 48. To fire a selected group of the resistor set 42, the printer sends an input voltage $V_{pp}$ on line 46, and transmits a full-duration firing control pulse 58 on line 56. In response to the firing control pulse, the firing pulse modulator 52 transmits the firing control pulse 58 to the resistor firing switches 48, causing the selected switches to close and connecting the resistors to ground to allow current flow through the resistors 44 to generate firing energy. The selected firing resistors 44 thus receive a firing pulse having the voltage level $V_{pp}$ that is applied to the primitive line 46, and a pulse duration as determined by the firing control pulse 58 and the firing pulse modulator 52. This firing pulse causes the ink associated with the selected firing resistors 44 to be ejected.

The printhead assembly 22 has a large number of nozzles 314 with a firing resistor 44 associated with each nozzle 314. In order to provide a printhead assembly where the resistors are individually addressable, but with a limited number of lines between the printer 10 and print cartridge 12, the interconnections to the resistors 44 in an integrated drive printhead are multiplexed. The print driver circuitry comprises an array of primitive lines 46, primitive commons 50, and address select lines 54 to control ink ejection elements 44. The printhead 22 may be arranged into any number of multiple similar subsections, such as quadrants, with each subsection being powered separately and having a particular number of primitives containing a particular number of resistors. Specifying an address line 54 and a primitive line 46 uniquely identifies one particular ink ejection element 44. The number of resistors within a primitive is equal to the number of address lines. Any combination of address lines and primitive select lines could be used, however, it is useful to minimize the number of address lines in order to minimize the time required to cycle through the address lines.

Each ink ejection element is controlled by its own drive transistor 48, which shares its control input address select with the number of ejection elements 44 in a primitive. Each ink ejection element is tied to other ink ejection elements 44 by a common node primitive select. Consequently, firing a particular ink ejection element requires applying a control voltage at its address select terminal and an electrical power source at its primitive select terminal. In response to print commands from the printer, each primitive is selectively energized by powering the associated primitive select interconnection. To provide uniform energy per heater ink ejection element only one ink ejection element is energized at a time per primitive. However, any number of the primitive selects may be enabled concurrently. Each enabled primitive select thus delivers both power and one of the enable signals to the driver transistor. The other enable signal is an address signal provided by each address select line only one of which is active at a time. Each address select line is tied to all of the switching transistors 48 so that all such switching devices are conductive when the interconnection is enabled. Where a primitive select interconnection and an address select line for a ink ejection element are both active simultaneously, that particular heater ink ejection element is energized. Only one address select line is enabled at one time. This ensures that the primitive select and group return lines supply current to at most one ink ejection element at a time. Otherwise, the energy delivered to a heater ink ejection element would be a function of the number of ink ejection elements being energized at the same time.

In existing printheads, an entire column of data is assembled in printer logic and the printer itself controls the sequence of energizing the printhead address and primitive lines which were demultiplexed. Moreover, these printheads have a dedicated connection to a primitive line, primitive ground and address line for each firing resistor. A one time calibration of each connection by either the printer or production circuitry external to the print cartridge compensates for any parasitic resistance or impedance in the unique path leading to each resistor. Existing printheads may be characterized at production to set these operating parameters. The printer then uses these operating parameters.

However, in new printheads having smart integrated logic on the printhead, data is transmitted to the printhead and the printhead decodes this data into address and primitive control signals. Data for all address lines must be sequentially sent to the printhead for each address line. In the time domain, this is one ejection period (or printing interval). In the physical location domain, this is called one column. These smart drive printheads have a large number of resistors making it difficult to have a direct connection for the address lines, primitive lines and primitive grounds. Accordingly, in smart drive printheads each firing resistor may not have a dedicated connection. Without a dedicated connection there may be variations in delivered energy to a resistor due to parasitic resistances. A set of resistors, or a primitive, is powered by a single voltage line (such as a voltage line 37*a* in FIG. 4A) that receives power via an electrical interconnection between the print cartridge electrical pads 312 and corresponding pads on the printer carriage 40. Power to the carriage 40 from the power supply 17 on the printer 10 is supplied by a flexible cable, or ribbon cable. The voltage line 37*a* continues from the electrical contact pads 312 on a flexible electrical tape circuit 30 to a bonding connection to electrodes 32 on the printhead die 22.

The printhead die 22 contains the firing resistors 44 and other control electronics, such as the drive transistors 48. The voltage line continues out from the printhead die 22 (such as via ground line 47*ab*) via a bonding connection to electrodes 32 on the printhead die 22 through the flexible electrical tape circuit 30 to print cartridge electrical pads. The voltage line continues to the carriage electrical interconnection between the print cartridge electrical pads 312 and to corresponding pads on the printer carriage 40. The voltage line continues from the carriage 40 to the power supply 17 via the flexible cable, or ribbon cable.

The impedance of the print cartridge electrical contacts 312, flex circuit bonding connections to the substrate, flex circuit trace resistances, substrate trace, transistor, resistor resistances, and other connections and lines, can vary from print cartridge to print cartridge. Also, the impedance of the print cartridge can vary over time, even when the voltage provided by the printer to each of the print cartridge electrical contacts is well controlled. Moreover, as the data load being printed changes, the current draw through the line and the voltage as measured at the firing resistor may be undesirably varied. For instance, when many or all resistors are fired simultaneously, the print cartridge voltage may be depressed by parasitic effects, giving a lower firing voltage than when only one or a few resistors are fired.

Because the voltage is regulated prior to the carriage to print cartridge interconnect, there is no consideration of the resistance past that point. Under heavy loading (i.e. single pass and/or high density prints), the parasitic voltage drop can be quite high. Since, the delivered energy is set such that heavy loads can print, light loads (i.e. multiple pass and/or low density prints), which do not experience nearly as high a voltage loss through the lines, can be given significant amounts of over-energy.

The significantly different energy requirements for a loaded versus unloaded condition can be attributed to the method in which the voltages are set on printers. Printers often regulate the printhead voltage based on a voltage sensed near the power supply 17. This voltage is before the printer flexible electrical cable from the printer 10 to the carriage 40 and therefore neglects the cable resistance as well as the resistance of the carriage 40 circuit board and the carriage to print cartridge interconnect. As the current required to drive the print cartridges increases, the parasitic voltage drop increases. The situation is improved if the regulator senses the voltage closer to the printhead, such as at the circuit board on the carriage 40 just before the carriage 40 electrical interconnects to the print cartridge 12, but a problem with parasitic resistances and voltage drop still remains.

In operation, the power supply voltage is set to a level adequate to ensure adequate firing energy levels for full drop volume firing in "blackout conditions", i.e., when a predetermined maximum number of resistors are fired simultaneously. Because firing energy is proportional to the product of the square of the voltage and the time duration, the power supply voltage must be high enough to provide adequate energy within the limited time afforded for printing each dot, before the next dot is to be printed at the desired printer scan rate. Part of the calibration process includes establishing a voltage to provide a firing energy threshold for all firing conditions, regardless of the number of resistors being fired simultaneously.

Experiments have shown that the amount of operating energy a printer needs to deliver to a print cartridge varies depending on how frequently the print cartridge is being fired, and also how frequently the other print cartridges in the printing system are being fired. A print cartridge firing only a few of its resistors and with no other print cartridge resistors being fired simultaneously, needed an operating energy at the printer contacts to the print cartridge which was much less than the operating energy required when the same print cartridge was printing with all of its resistors firing. Also, a print cartridge firing only a few of its resistors, but with other print cartridge resistors being fired simultaneously, needed an operating energy which was approximately the same as the operating energy required when the same print cartridge was printing with all of its resistors firing.

This creates a problem because when the operating energy is set high enough to power a print cartridge when all of its resistors and all of the resistors of all the other print cartridges are being fired, too much energy is delivered to the print cartridge when only a few of its resistors of are being fired and no other print cartridges are being simultaneously fired. This excess energy leads to rapid formation of films on the resistors ("kogation"). High amounts of excess energy are also implicated in shortened resistor life and the generation of excess heat in the printhead. High amounts of excess energy also may cause thermal shutdown and no drop ejection.

As discussed above, with direct drive and integrated drive printheads using multiplexing each of the primitives has a direct connection to a constant voltage source and therefore primitives have very little effect on each other. However, with the new smart drive printheads these primitives may be coupled together and connected to a constant voltage source. This means that when a different number of these coupled primitives are fired, they utilize differing amounts of current from the voltage source. Thus, the resistances in the circuit which are common to the different primitives cause a parasitic voltage loss which is proportional to the number of primitives fired.

By dividing the firing resistors 44 on the printhead die 22 into groups, such as quadrants Q1 through Q4 as illustrated in FIG. 4A, and supplying the firing energy to each quadrant with an independently controlled power source 17*a*–17*d* from a different line 37*a*–37*d* of the power bus 18, the present invention advantageously reduces the adverse effects of the parasitic resistances in printheads having a large number of ink ejection elements. Because one resistor can be fired in each of the nine primitives during a printing interval, the voltage drop due to parasitic resistances can vary by a 9:1 ratio for each quadrant. However, if all resistors were controlled by the same single power supply, this power supply would have to be capable of compensating for a voltage drop from firing one resistor in all 36 quadrants, a 36:1 ratio. In order to ensure that the proper operating energy would be delivered to the firing resistors in all cases, the operating voltage of the single supply would have to be set to a substantially higher voltage than would the operating voltage of four individual supplies, thus increasing the risk of kogation and excess-heat-related problems discussed previously.

Additional details regarding the control of inkjet printheads are described in U.S. patent application Ser. No. 09/016,478, filed Jan. 30, 1998, entitled "Hybrid Multi-Drop/Multi-Pass Printing System" and U.S. patent application Ser. No. 08/962,031, filed Oct. 31, 1997, entitled "Ink Delivery System for High Speed Printing" which have been heretofore incorporated by reference.

Figure 5:
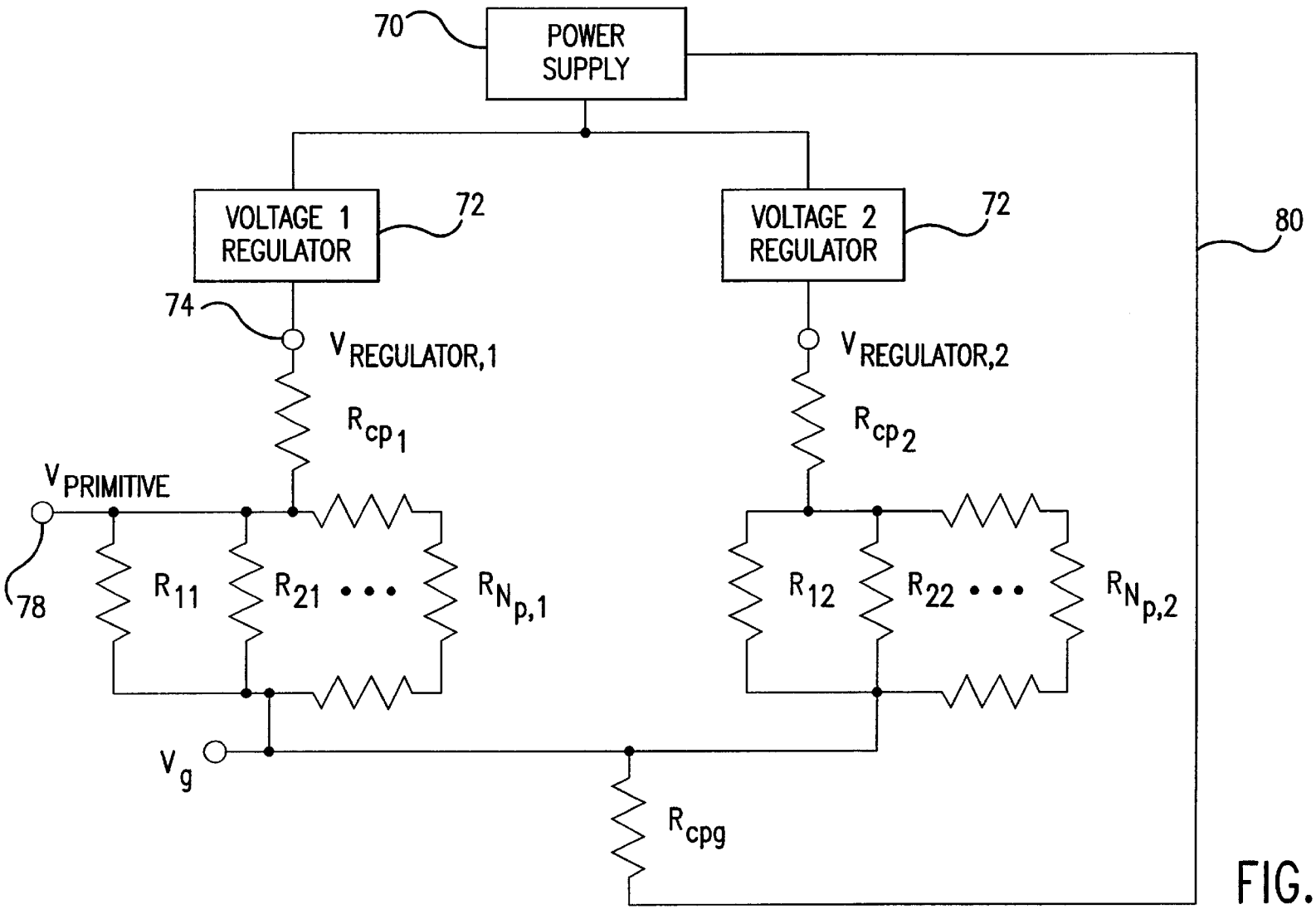
FIG. 5 is a schematic circuit diagram of an early second embodiment of the present invention showing a single power supply with independent voltage regulators.

An early second embodiment of the present invention, as best understood with reference to a simplified schematic diagram of such an arrangement as illustrated in FIG. 5, has a single power supply 70 but provides separate voltage regulators 72 for different print cartridges sharing a common ground line 80. The inputs of the voltage regulators 72 are each preferably connected to the DC output of the power supply 70. During operation, the voltage regulators can be independently set to different voltage levels. The primary purpose of this is to compensate for the effect of parasitic resistances in the print cartridges and in the common ground lines. In this case, the amount of current drawn by a second print cartridge can affect the firing voltage of the other print cartridge (and thus its firing energy) as follows.

The first effect is power supply sag. With one print cartridge firing at a high duty cycle, the power supply and voltage regulators may be unable to maintain $V_{regulator,\ 1}$ and $V_{regulator,\ 2}$ at their necessary levels. The present invention deals with this by setting $V_{regulator}$ set to a higher voltage than would be normally needed in case the second voltage regulator pulls more current than the power supply can deliver without sagging. Then, when the second print cartridge is not firing at a high duty cycle, the power supply does not sag and excess energy is applied to the print cartridge powered by the first voltage regulator.

The second effect occurs if the print cartridges are connected to a common ground, and there is a common parasitic resistance in the ground line 80 between the print cartridges and the power supply 70, shown as $R_{cpg}$. Here a high duty cycle in one print cartridge creates a ground voltage, $V_g$, through the current flowing through $R_{cpg}$. This means the voltage dissipated in the primitives (for firing the print cartridge) is decreased from $V_{primitive}$ to $V_{primitive}-V_g$. To compensate for this, $V_{regulator}$ must be set proportionally higher using equations similar to those shown in the first example. In this case, when the second print cartridge does not fire, the first print cartridge is supplied with excess voltage and energy.

Using the early second embodiment, $V_{regulator}$ would not necessarily be set assuming the maximum parasitic loss possible. Instead, the printmode, number of simultaneously firing primitives, and number of simultaneously firing print cartridges would all be factors.

Accordingly, print cartridges having shared power and ground lines and parasitic resistances in these lines result in variations in delivered energy to the primitives in a print cartridge. The invention takes these common parasitic resistances into account and adjusts the target operating voltage. More specifically, it considers a predetermined number of primitives which can fire simultaneously and adjusts the target voltage of the voltage regulator to compensate for the maximum expected voltage loss through the common parasitic resistances.

Although the primary purpose of the voltage regulator-per-print cartridge approach is to compensate for parasitic resistances, as described above, the various voltage regulators can also be set to different voltage levels in order to accommodate the differences in firing voltage for different print cartridges.

Figure 6A:
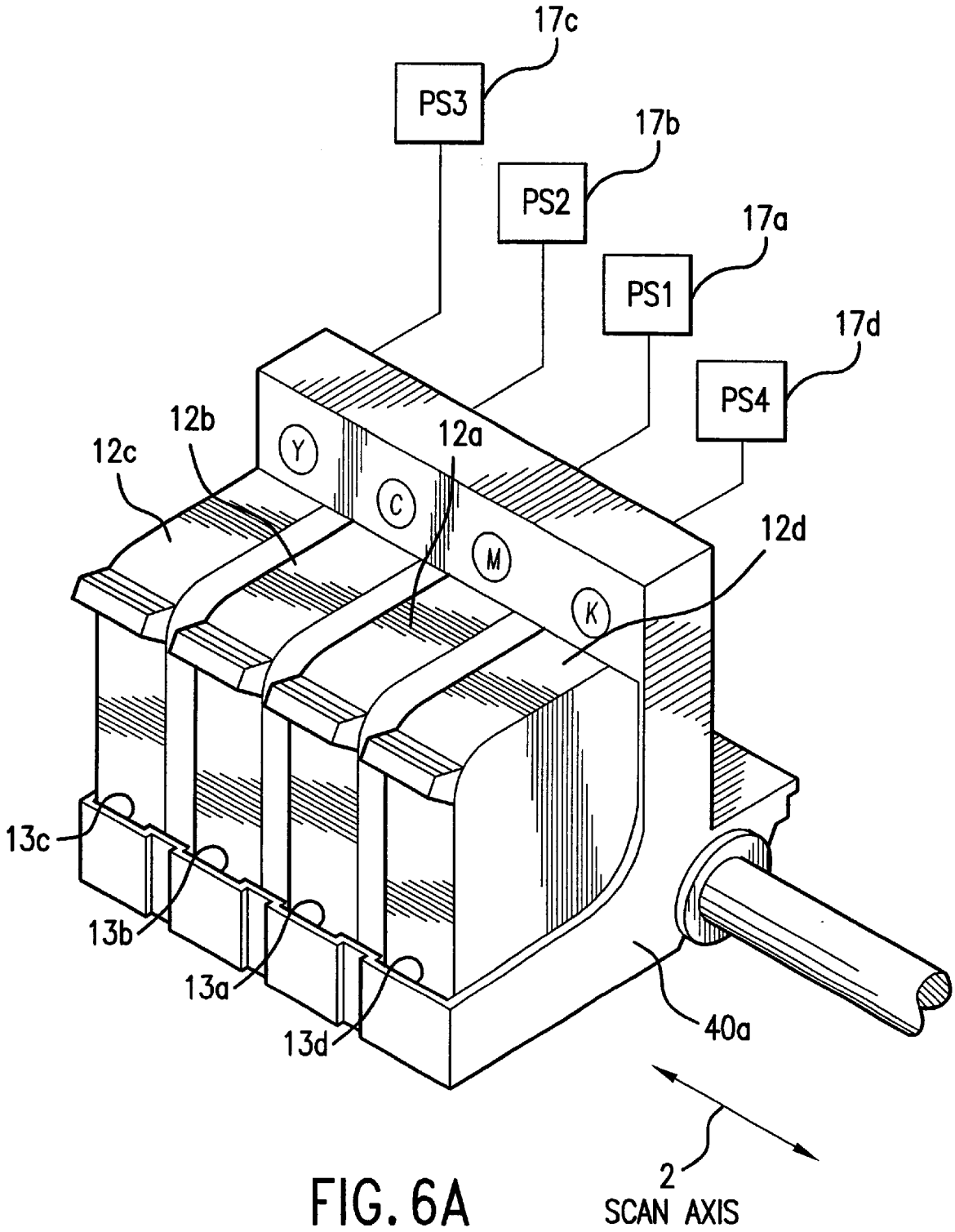
FIG. 6A shows a print cartridge arrangement in a scanning carriage having four separate print cartridges for magenta, cyan, yellow, and black inks usable with the inkjet printers of FIGS. 1A and 1B.

In a presently preferred second embodiment of the present invention, and as best understood with reference to the schematic block diagram of FIG. 6A, a carriage 40*a* of a printing system 10 has four receiving slots 13*a*–13*d* which are adapted to receive three print cartridges 12 each supplying a different color ink (magenta from cartridge 12*a*, cyan from cartridge 12*b*, and yellow from cartridge 12*c*), and a black ink print cartridge 12*d*. Typically a specific color print cartridge is assigned to a specific slot, and the cartridges, the slots, or both are keyed or sized so as to allow only the proper cartridge to be inserted into the slot. The printhead 22 of each cartridge 12*a*–12*d* installed in the carriage 40 has a dual-column array of ink ejection elements, as best viewed with reference to FIG. 6B. The printing system 10 also has four independently controllable power supplies 17*a*–17*d*, each one of which is electrically connected for supplying firing energy to a different one of the ink cartridges. The input of the power supplies 17*a*–17*d* are preferably connected to the AC mains. The output of power supply 17*a* is connected to the magenta cartridge 12*a*, supply 17*b* is connected to the cyan cartridge 12*b*, supply 17*c* is connected to the yellow cartridge 12*c*, and supply 17*d* is connected to the black cartridge 12*d*. While the schematic representation of FIG. 6A (and FIGS. 7A–7B which will be discussed subsequently) shows only a single output line from each power source 17 connected to the print cartridge 12, those skilled in the art will appreciate that both power and ground connections are made from each power source to the electrical connect pads of the associated print cartridge (s); the ground lines of each supply 17 are preferentially disconnected from each other, but some of the ground lines may be commonly connected in alternate embodiments. Typically, the output of at least two of the four supplies 17*a*–7*d* will be set to different voltage levels in order to compensate for differences in the firing energy requirements of different print cartridges 12 and while keeping the firing time in an acceptable range. One of the advantages of using independently controllable power supplies 17*a*–17*d* to provide optimal firing voltage levels to the resistors in the different printheads is that ink drops of uniform volume are ejected from the different ink ejection elements of all three color cartridges 12*a*–12*c* and the black cartridge 17*d*, which contributes to high print quality. Independently setting each power supply 17*a*–17*d* to the appropriate voltage level for the particular color ink also reduces energy waste, excess heat generation, and accelerated print component aging, compared to using a single power supply commonly connected to all print cartridges and whose voltage must therefore be set high enough to provide adequate firing energy to the cartridge whose ink requires the highest firing energy.

Figure 7A:
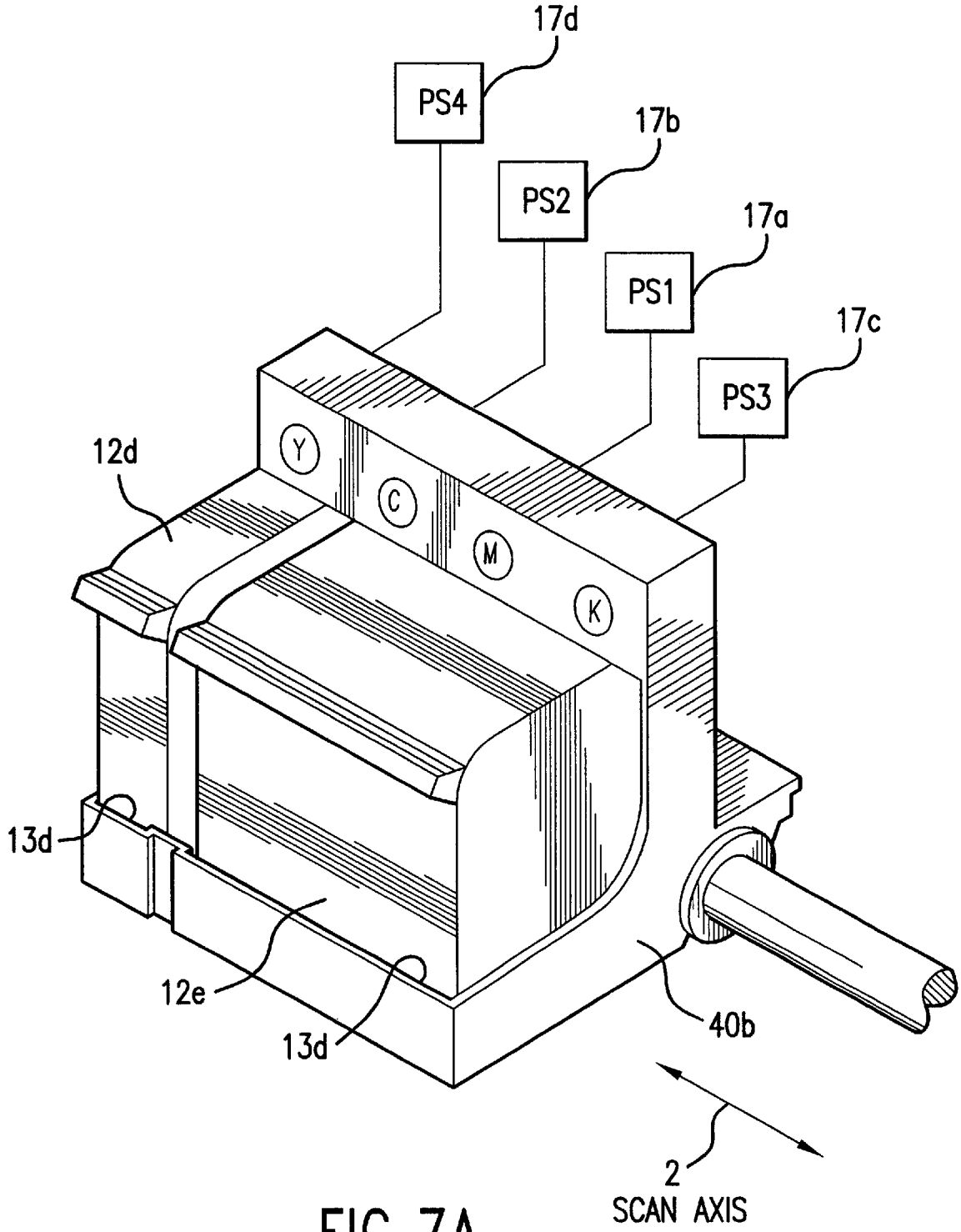
FIG. 7A shows another print cartridge arrangement in a scanning carriage having one separate print cartridges for black ink along with a multicolor tri-compartment print cartridge for magenta, cyan, and yellow inks, the print cartridge arrangement usable with the inkjet printers of FIGS. 1A and 1B.
Figure 7B:
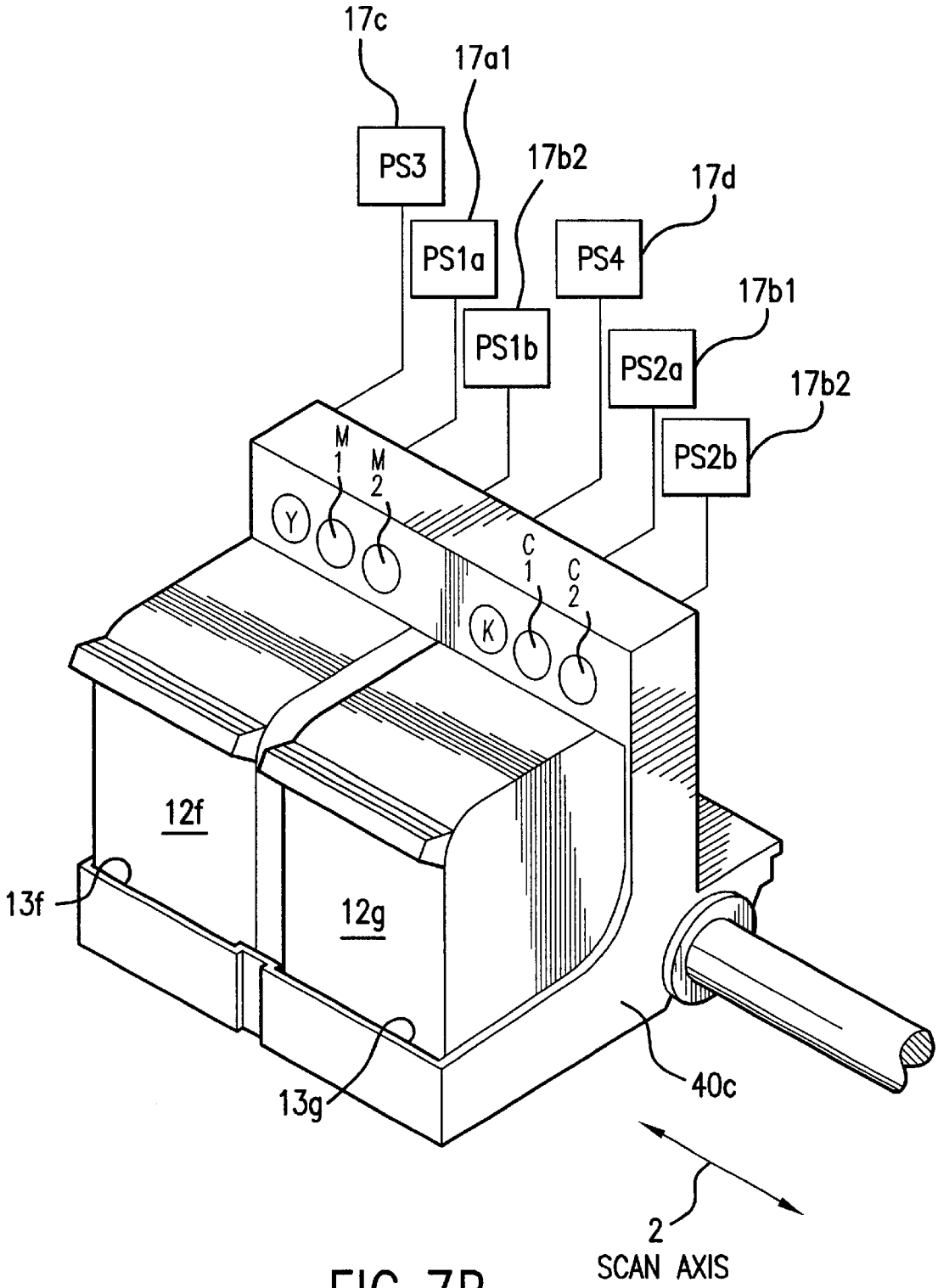
FIG. 7B shows yet another print cartridge arrangement in a scanning carriage having one multicolor tri-compartment print cartridge for yellow, light magenta, and dark magenta inks, along with another tri-compartment print cartridge for black, light cyan, and dark cyan inks, the print cartridge arrangement usable with the inkjet printers of FIGS. 1A and 1B.

In a third embodiment of the present invention, and as best understood with reference to the schematic block diagram of FIGS. 7A and 7B, a carriage 40 of a printing system 10 is adapted to receive one or more multicolor print cartridges 12*e*–12*g*, each of which supplies at least two different color inks. Each of the cartridges 12*e*–12*g* typically has separate compartments for each of the different color inks in order to keep them from intermixing in the cartridge. The carriage 40 has electrical contact pads (not shown) which mate with the interconnect pads 312 on the print cartridges 12 to supply power, data, and control signals for printing. In one configuration, and as best understood with reference to FIG. 7A, the carriage 40*b* has two receiving slots 13*e*, 13*d* into which are installed respectively a tri-color print cartridge 12*e* which supplies cyan, magenta, and yellow inks, and a black ink print cartridge 12*d*. Typically a specific color print cartridge is assigned to a specific slot, and the cartridges, the slots, or both are keyed or sized so as to allow only the proper cartridge to be inserted into the slot. The printing system 10 also has four independently controllable power supplies 17*a*–17*d*, each one of which is electrically connected for supplying firing energy for a color ink. Because cartridge 12*e* prints three different color inks, three different power supplies 17*a*–17*c* are connected to cartridge 12*e* via interconnect pad 312 arrangements on the flex circuit 306, as will be discussed subsequently in further detail. Power supply 17*a* controls printing of magenta ink M, power supply 17*b* controls printing of cyan ink C, and power supply 17*c* controls printing of yellow ink Y. Power supplies 17*a*–17*d* are each independently set to provide the optimal voltage level for the ink ejection elements associated with each particular color ink.

In another configuration, and as best understood with reference to FIG. 7B, the carriage 40*c* has two slots 13*f*, 13*g* for receiving two multicolor ink print cartridges, one cartridge 12*f* supplying yellow ink and two different shades of magenta ink, and another cartridge 12*g* supplying black ink and two different shades of cyan ink. Typically a specific color print cartridge is assigned to a specific slot, and the cartridges, the slots, or both are keyed or sized so as to allow only the proper cartridge to be inserted into the slot. The printing system 10 also has six independently controllable power supplies 17*a*–17*d*, each one of which is electrically connected for supplying firing energy for a different color ink. Because cartridges 12*f*–12*g* each print three different color inks, three different power supplies are connected to these cartridges via mating contact pad and interconnect pad 312 arrangements. For cartridge 12*f*, power supply 17*c* controls printing of yellow ink Y, power supply 17*a*1 controls printing of a first shade M1 of magenta ink, and power supply 17*a*2 controls printing of a second shade M2 of magenta ink. Similarly, for cartridge 12*g*, power supply 17*d* controls printing of black ink K, power supply 17*b*1 controls printing of a first shade C1 of cyan ink, and power supply 17*b*2 controls printing of a second shade C2 of cyan ink. The six power supplies 17*a*–17*d* are each independently set to provide the optimal firing voltage level for the ink ejection elements associated with each particular color ink. According to the present invention, the number of print cartridges, number of carriage slots, and number of ink colors per print cartridge can be varied from those described above, which are included for purposes of illustration and not limitation.

Considering now the arrangement of the ink ejection elements on the printhead die 22 contained in multicolor ink print cartridges 12*e*–12*g*, and with reference to FIGS. 8A and 8B, each printhead 22*a*–22*b* contains multiple arrays of ink ejection elements, with one array associated with each color ink printed by the cartridge 12*e*–12*g*. The arrays can be positioned on the printhead in different arrangements. Printhead 22*a* has a staggered arrangement of ink ejection element arrays wherein three arrays 176*a*–176*c* are staggered along the media advance axis 4 to print non-overlapping swaths for each color during a single printing pass of the carriage 40 along the scan axis 2. Alternatively, printhead 22*b* has a staggered arrangement of ink ejection element arrays wherein three arrays 177*a*–177*c* are aligned along the media advance axis 4 to print overlapping swaths for each color during a single printing pass of the carriage 40 along the scan axis 2.

Figure 9:
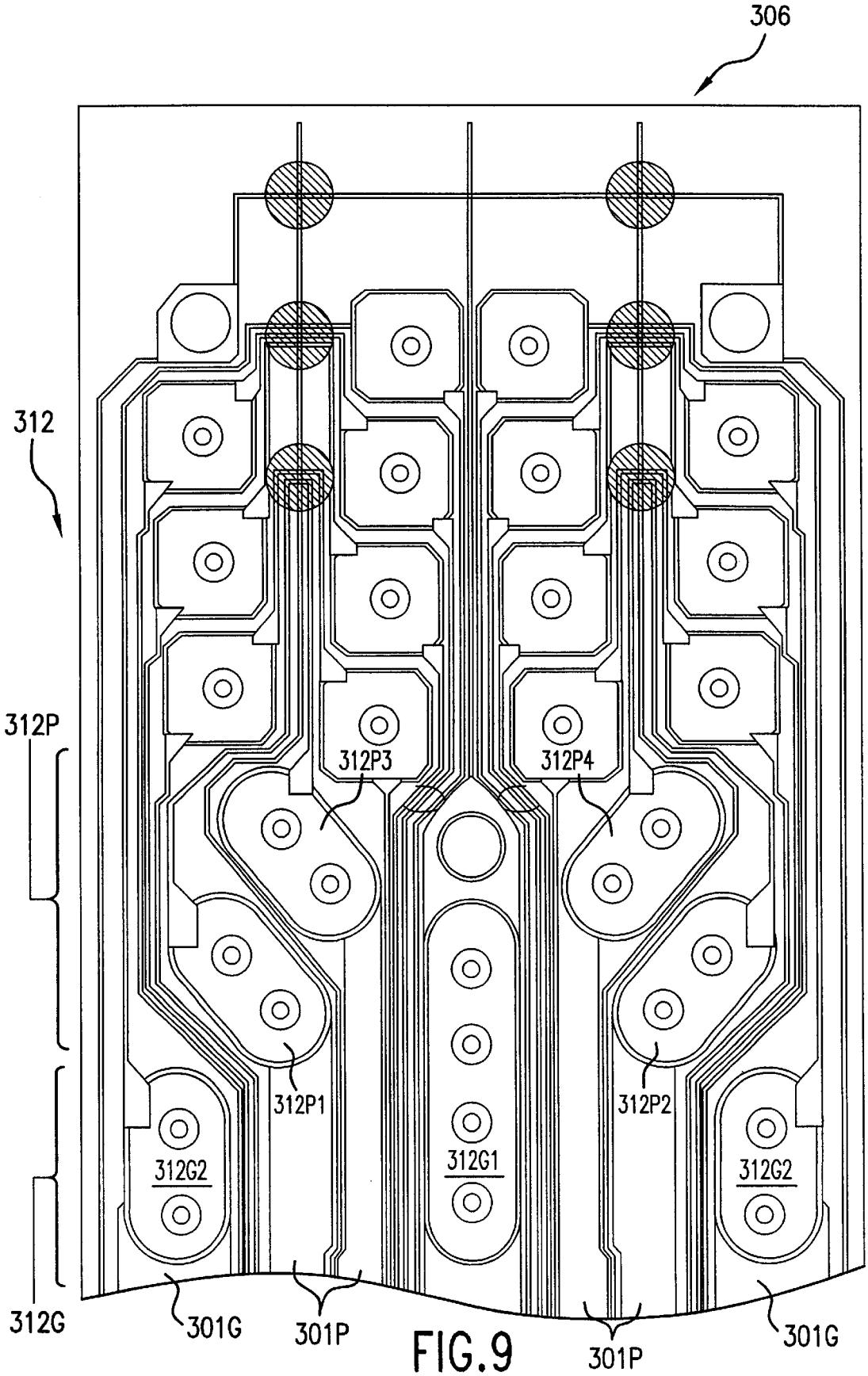
FIG. 9 shows a portion of the interconnect pads and traces of a flex circuit usable in the print cartridge of FIG. 2A.

Considering now in further detail the connection of multiple power supplies 17 to a single multicolor print cartridge 12*e*–12*g*, and with reference to FIGS. 2B and 9, the flex circuit 306 contains interconnect pads 312 including a plurality of power interconnect pads 312P. Included on the flex circuit 306 is at least two power: interconnect pads 312P (FIG. 9 shows four such pads, 312P1–312P4) for conducting power signals from power supplies 17 in the printer 10 to each of the ink ejection element arrays for the different color inks contained in the print cartridge 12*e*–12*g*. Each power interconnect pad 312P is connected to an electrically conductive trace 301P on the flex circuit 306, which in turn is connected to the printhead die 22 attached to the flex circuit 306. Also included on the flex circuit 306 are one or more ground interconnect pads 312G (FIG. 9 shows three such pads, 312G1–312G2) for returning ground current from the print cartridge 12*e*–12*g* to the power supplies 17. As with the power interconnect pads 312P, each ground interconnect pad 312G is connected to an electrically conductive trace 301G on the flex circuit 306, which in turn is connected to the printhead die 22 attached to the flex circuit 306. A corresponding ground interconnect pad 312G may exist for each power interconnect pad 312P, the pair for connection to a specific power supply 17. Alternatively, a single ground interconnect pad 312G may be used with more than one: power interconnect pad 312P, with the ground commonly connected to all of the power :supplies 17 connected to the power interconnect pads 312P.

A similar flex circuit arrangement can be used to provide different power signals to the different sections, such as quadrants, of a printhead die 22 for a single color ink. In this case, each of power interconnect pads 312P1–312P4 may be connected to a different section or quadrant of the printhead die, and ground interconnect pads 312G may provide specific or common ground current return paths to the power supplies 17 as described above.

Figure 10A:
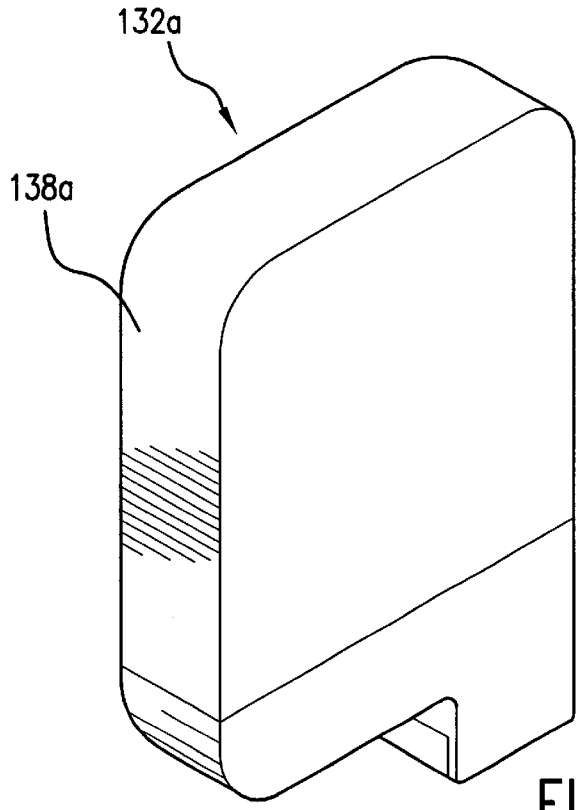
FIGS. 10A–10D are schematic representations of alternative printhead and ink reservoir configurations usable with the inkjet printers of FIGS. 1A and 1B.
Figure 10B:
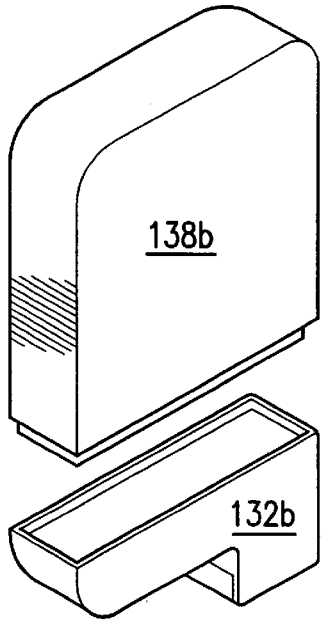
Figure 10C:
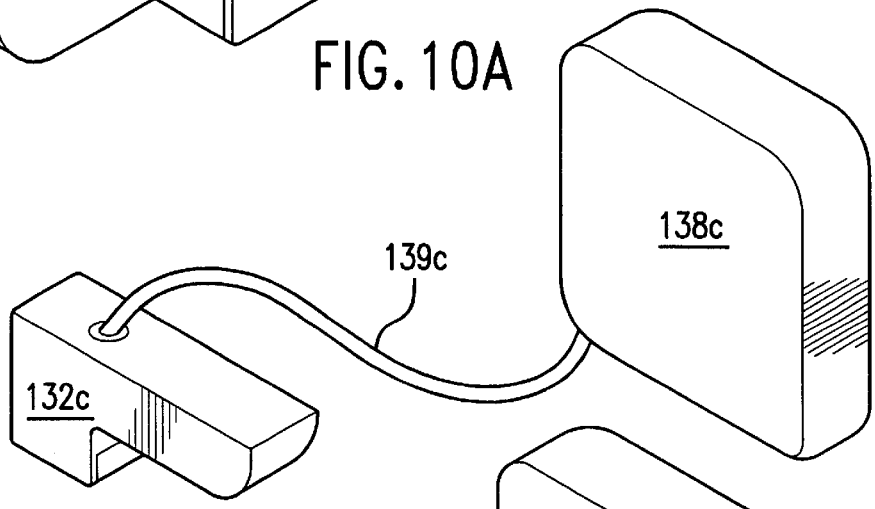
Figure 10D:
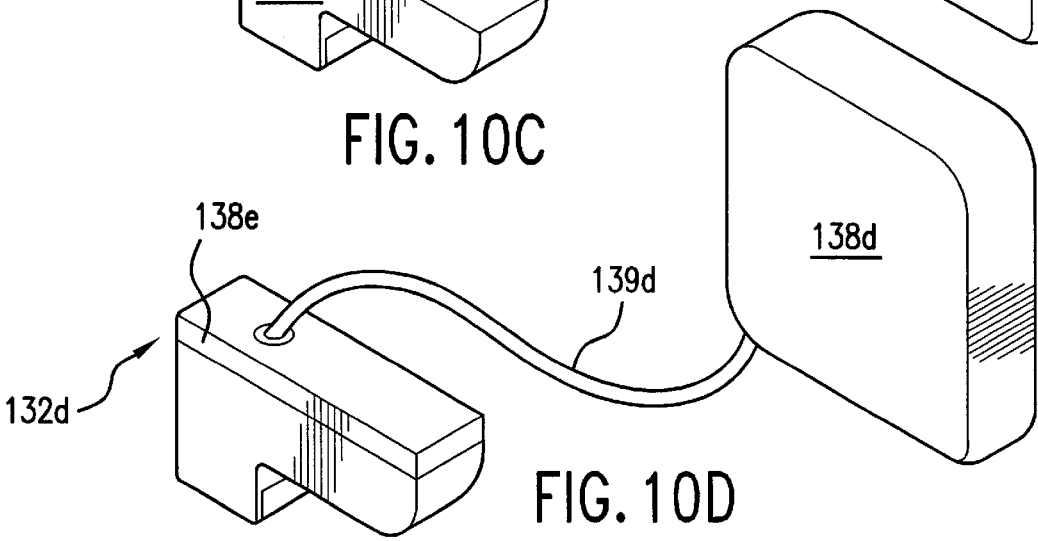

A number of alternative arrangements for delivering ink to the thermal inkjet head assembly 302 are usable with the present invention. Each thermal inkjet head assembly 302 is housed in a cartridge 132*a*–132*d*. A cartridge 132*a*–132*d* may contain only one thermal inkjet head assembly 302 for one ink color, or it may contain multiple printheads with multiple compartments for different color inks, such as a tricolor cartridge containing three printheads for cyan, magenta, and yellow respectively. As illustrated schematically in FIGS. 10A through 10D, the ink may be supplied to the thermal inkjet head assembly 302 in different ways. In FIG. 10A, an ink reservoir 138*a* is housed within the print cartridge 132*a* along with the printhead. In FIG. 10B, an ink reservoir 138*b* is detachable from the print cartridge 132*b*, but the reservoir 138*b* is attached to the print cartridge 132*b* when they are installed in the carriage 20. In FIG. 10C, the print cartridge 132*c* does not contain an ink reservoir; ink is supplied to the cartridge 132*c* instead from an off-chute ink reservoir 138*c* via a tube 139*c*. In FIG. 10D, the main ink reservoir 138*d* is similarly located off-chute and connected to the print cartridge 132*d* via a tube 139*d*, but the print cartridge 132*d* also contains an auxiliary reservoir 138*e*. The present invention may be utilized with any of these cartridge configurations and ink delivery systems, and with other design alternatives in which the thermal inkjet head assembly 302 and the print media 34 are in relative motion to each other.

Figure 11:
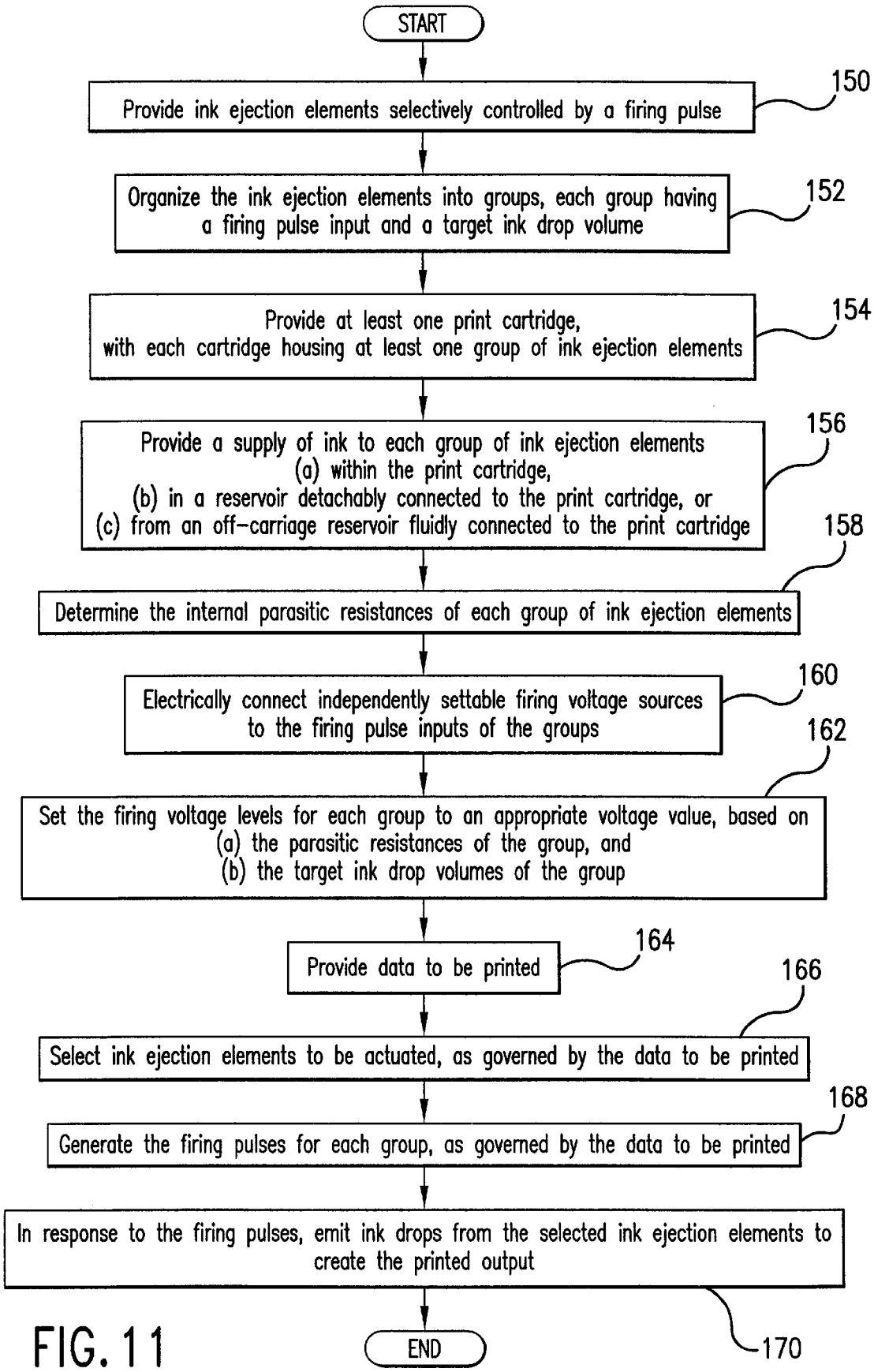
FIG. 11 is a flowchart of a method of printing according to the present invention with the inkjet printers of FIGS. 1A and 1B.

Considering now a method of printing with an inkjet printer according to the present invention, and with reference to FIG. 11, the method begins at 150 by providing multiple ink ejection elements that are selectively controlled by a firing pulse. At 152, the ink ejection elements are organized into groups, with each group having a common firing pulse input which is applied to certain of the ink ejection elements in the group. Each group also has a predefined ink drop volume associated with the ink ejection elements in the group. At 154, at least one print cartridge is provided, with each cartridge housing at least one group of ink ejection elements. At 156, a supply of ink is provided to each group of ink ejection elements. The ink can be supplied in several ways, corresponding to the previously described alternative arrangements for delivering ink. The ink may be contained within a print cartridge 132*a*; the ink may be contained in a reservoir, such as a reservoir 138*c*, detachably connected to the print cartridge 132*b*; or the ink may be supplied from an off-carriage reservoir, such as reservoir 138*c*, fluidly connected to the print cartridge. At 158, the internal parasitic resistances of each group of ink ejection elements is determined. Preferably, this is accomplished during a calibration process that can be done either at the time of manufacture of the cartridge, or periodically thereafter. At 160, independently settable firing voltage sources are electrically connected to the firing pulse inputs of each of the groups. At 162, the voltage sources are set to the appropriate firing voltage values for each ink ejection element group, based on the parasitic resistances of the group, and the target ink drop volumes of the group. At 164, data to be printed on a print media using the inkjet printer is provided. At 166, the ink ejection elements to be actuated are selected based on the data to be printed. At 168, the firing pulses for each group are generated, also as governed by the data to be printed. At, 170, and in response to the firing pulses, ink drops from the selected ink ejection elements are emitted in order to create the printed output on the print media. Following 170, the method ends.

From the foregoing it will be appreciated that the printer and method provided by the present invention represents a significant advance in the art. A printer can be constructed according to the present invention so as to produce high quality printed output by the provision of multiple independently controllable power supplies. Although several specific embodiments of the invention have been described and illustrated, the invention is not to be limited to the specific methods, forms, or arrangements of parts so described and illustrated. In particular, the present invention can be incorporated in any thermal inkjet head assembly and printer configuration. The invention is usable with unidirectional printing where printing is performed only when the carriage is moving in one direction along the scan axis, or bidirectional printing where printing is performed when the carriage is moving in either direction along the scan axis. The invention may be used with printing systems in which all the components of the printer may not be located in the same physical enclosure. Multicolor print cartridges can include either a single printhead for all the color inks, or multiple printheads. A multicolor print cartridge according to the present invention is not limited to any specific number of inks. Furthermore, while the invention has been described for purposes of illustration in terms of the printing of inks on print media, the invention is usable for depositing drops of other types of fluids, and depositing them on various types of media other than paper and transparencies. In addition, while a flex circuit has been disclosed as the preferred structure for containing the conductive traces, other similar structures known in the art such as printed circuit boards may be utilized. The invention is limited only by the claims.

What is claimed is:

1. An inkjet printing system for printing on a media, comprising:

a frame;

a carriage movably mounted to the frame with respect to the media, the carriage having at least one slot adapted to receive a corresponding at least one print cartridge, the at least one print cartridge having a plurality of groups of ink ejection elements, each ink ejection element individually actuable by a firing energy to emit drops of an ink; and a plurality of power sources disposed in the inkjet printing system for supplying the firing energy, the plurality of power sources having a corresponding plurality of independently settable voltages, wherein certain ones of the plurality of power sources are electrically connected to corresponding ones of the groups of ink ejection elements, and wherein the voltages for the certain ones of the plurality of power sources are set to an appropriate voltage value for the corresponding group.

2. The inkjet printing system of claim 1, wherein all of the groups of ink ejection elements emit drops of the same color ink.

3. The inkjet printing system of claim 1, wherein at least two of the groups of ink ejection elements emit drops of different color inks.

4. The inkjet printing system of claim 1, wherein the at least two of the groups are located in a single print cartridge.

5. The inkjet printing system of claim 1, wherein each group of ink ejection elements has a drop volume, and wherein at least two of the groups of ink ejection elements emit drops of different color inks but the same drop volume.

6. The inkjet printing system of claim 1, wherein the voltages for at least two of the groups of ink ejection elements are different.

7. The inkjet printing system of claim 1, wherein all of the groups of ink ejection elements are located in a single print cartridge.

8. The inkjet printing system of claim 1, wherein each of the at least one print cartridges contains groups of elements for only a single color ink.

9. The inkjet printing system of claim 1, wherein all of the groups of ink ejection elements for a single color ink are located in the same print cartridge.

10. The inkjet printing system of claim 1, wherein each print cartridge includes only one group of ink ejection elements.

11. The inkjet printing system of claim 1, wherein the plurality of power sources are a plurality of power supplies, each power supply having independently settable output voltages.

12. The inkjet printing system of claim 11, wherein each of the plurality of power supplies has an input line connected to the AC power mains.

13. The inkjet printing system of claim 11, wherein at least two of the plurality of power supplies have output ground lines which are commonly connected.

14. The inkjet printing system of claim 1, wherein the plurality of power sources includes at least one power supply having an output connected to a plurality of voltage regulators, each voltage regulator having independently settable output voltages.

15. The inkjet printing system of claim 14, wherein at least two of the plurality of voltage regulators have output ground lines which are commonly connected.

16. A print cartridge for printing drops of different inks using an inkjet printer, comprising:

a printhead die mounted in the print cartridge having a plurality of groups of ink ejection elements, each group for controllably ejecting drops of an ink; and a plurality of firing pulse inputs, certain ones of the firing pulse inputs commonly connected to certain other ones of the groups of ink ejection elements in order to controllably eject the drops of the ink; and a conductive circuit connected to the printhead die, the circuit having a plurality of power interconnect pads, each pad for receiving one of a plurality of firing pulses, and a corresponding plurality of electrically conductive traces for conducting the firing pulses to the firing pulse inputs.

17. The print cartridge of claim 16, wherein the ink is a different color ink for at least some differently colored ones of the groups of ink ejection elements.

18. The print cartridge of claim 17, wherein each of the ejected drops has a drop volume, and wherein the drop volumes are different for at least some of the differently colored ones of the ink ejection element groups.

19. The print cartridge of claim 17, wherein each of the ejected drops has a drop volume, and wherein the drop volumes are substantially the same for at least some of the differently colored ones of the ink ejection element groups.

20. The print cartridge of claim 17, wherein each different color ink is selected from the group consisting of black, magenta, cyan, yellow, light magenta, light cyan, dark magenta, and dark cyan.

21. The print cartridge of claim 17, wherein at least two of the firing pulse inputs are each connected to different ones of the differently colored ones of ink ejection element groups.

22. The print cartridge of claim 16, wherein each of the ejected drops has a drop volume, and wherein the drop volumes are different for at least some of the different groups of ink ejection elements.

23. The print cartridge of claim 16, wherein each of the plurality of firing pulses has a corresponding one of a plurality of voltages, and wherein at least two of the plurality of voltages have different voltage values.

24. The print cartridge of claim 23, wherein each ink ejection element group has a parasitic resistance, and wherein the different voltage values compensate for the corresponding parasitic resistance so as to provide a predetermined firing energy to the corresponding ink ejection element group.

25. The print cartridge of claim 22, wherein each ink ejection element group has a predetermined drop volume, and wherein each of the different voltage values provide a corresponding predetermined firing energy to each of the ink ejection element groups.

26. The print cartridge of claim 16, wherein each of the plurality of firing pulses has a corresponding one of a plurality of voltages, and wherein each of the plurality of voltages have different voltage values.

27. The print cartridge of claim 16, further including:

a plurality of power supplies electrically connected to the power interconnect pads, each of the power supplies for supplying one of the plurality of firing pulses to the print cartridge.

28. The print cartridge of claim 16, further including:

a power source electrically connected to the power interconnect pads for supplying the plurality of firing pulses to the print cartridge.

29. A method for printing with an inkjet printer, comprising:

providing a plurality of groups of ink ejection elements, the elements in each group selectively ejecting ink in response to a corresponding one of a plurality of firing pulses;

providing independently settable firing voltage levels for each of the plurality of firing pulses;

setting each of the firing voltage levels to an appropriate voltage value for the corresponding one of the plurality of groups of ink ejection elements; and selectively generating the firing pulses for each group as governed by the data to be printed so as to emit ink drops from at least some of the ink ejection elements in at least two of the groups.

30. The method of claim 29, further comprising:

selecting the ink ejection elements from which ink drops are to be printed, as governed by print data.

31. The method of claim 29, wherein the setting each of the firing voltage levels further comprises selecting a voltage value required to emit a desired ink drop volume from the ink ejection elements in the group.

32. The method of claim 29, further comprising:

determining parasitic resistances of certain ink ejection elements group so as to establish the appropriate voltage value for these certain groups.

33. The method of claim 29, further comprising:

electrically connecting certain ones of a plurality of voltage sources to corresponding ones of the ink ejection element groups so as to provide the independently settable firing voltage levels.

34. The method of claim 29, further comprising:

providing at least one print cartridge, each cartridge housing at least one of the groups of the ink ejection elements.

35. The method of claim 34, further comprising:

providing a supply of ink to each group of ink ejection elements, the supply of ink located in a location selected from the group consisting of within the print cartridge, in a reservoir detachably connected to the print cartridge, and in an off-carriage reservoir fluidly connected to the print cartridge.

36. A method for printing with an inkjet printer, comprising:

independently setting an appropriate firing pulse voltage level for each of a plurality of firing pulses, each firing pulse associated with a group of ink ejection elements; and selectively generating individual ones of the plurality of firing pulses as governed by the data to be printed so as to emit ink drops from at least some of the ink ejection elements in at least two of the groups.

* * * * *